US011390455B2

(12) United States Patent
Holden et al.

(10) Patent No.: US 11,390,455 B2
(45) Date of Patent: Jul. 19, 2022

(54) STACKABLE BULK CONTAINER

(71) Applicants: Custom Metalcraft, Inc., Springfield, MO (US); Deborah Nichole Holden, Springfield, MO (US)

(72) Inventors: Clark Austin Holden, Springfield, MO (US); Deborah Nichole Holden, Springfield, MO (US); Rodney Arthur Mease, Reeds Spring, MO (US); Peter Joseph Brunn, Hilton Head Island, SC (US); Gregory Paul Stout, Stow, OH (US); Dwayne Holden, Springfield, MO (US)

(73) Assignee: Custom Metalcraft, Inc., Springfield, MO (US)

( * ) Notice: Subject to any disclaimer, the term of this patent is extended or adjusted under 35 U.S.C. 154(b) by 0 days.

(21) Appl. No.: 16/810,330

(22) Filed: Mar. 5, 2020

(65) Prior Publication Data

US 2020/0369463 A1 Nov. 26, 2020

Related U.S. Application Data

(60) Provisional application No. 62/852,077, filed on May 23, 2019.

(51) Int. Cl.
*B65D 88/02* (2006.01)
*B65D 21/02* (2006.01)
(Continued)

(52) U.S. Cl.
CPC ..... *B65D 88/022* (2013.01); *B65D 19/003* (2013.01); *B65D 21/0209* (2013.01);
(Continued)

(58) Field of Classification Search
CPC ..... B65D 88/54; B65D 77/0466; B65D 21/0209; B65D 21/0215; B65D 21/0213;
(Continued)

(56) References Cited

U.S. PATENT DOCUMENTS 3,325,058 A 6/1967 West, Jr.
3,331,529 A * 7/1967 Slapnik ..... B65D 21/0213 206/508

(Continued)

*Primary Examiner* — Anthony D Stashick
*Assistant Examiner* — Raven Collins
(74) *Attorney, Agent, or Firm* — Hovey Williams LLP

(57) ABSTRACT

A stackable container system is configured to provide stacked receptacles for receiving bulk material therein. The stackable container system includes a first receptacle configured to provide a respective stacked receptacle. The first receptacle includes a receptable bottom, a receptable top, and a receptacle side extending along an upright container axis between the receptacle bottom and top, with the first receptacle presenting a container chamber. The receptacle top is configured to at least partly support another one of the stacked receptacles stacked relative thereto along the upright container axis. The receptacle top and the receptacle side have, respectively, a top peripheral margin and a side peripheral margin that extend laterally about the upright container axis, with at least part of the top peripheral margin being laterally outboard of the side peripheral margin. At least part of the top peripheral margin is interconnected to the side peripheral margin along a transition section that extends laterally between the receptacle top and the receptacle side.

7 Claims, 44 Drawing Sheets

(51) Int. Cl.
*B65D 88/54* (2006.01)
*B65D 19/00* (2006.01)

(52) U.S. Cl.
CPC ..... *B65D 88/02* (2013.01); *B65D 88/54* (2013.01); *B65D 2588/125* (2013.01)

(58) Field of Classification Search
CPC ..... B65D 88/1643; B65D 21/023; B65D 21/0211; B65D 21/0216
USPC ..... 220/23.91, 23.87; 206/600, 386
See application file for complete search history.

(56) References Cited

U.S. PATENT DOCUMENTS 3,785,534 A 1/1974 Smith
5,197,601 A * 3/1993 Sterett ..... B65D 11/06 206/386
5,253,777 A 10/1993 Schutz
5,269,414 A 12/1993 Hollander
5,280,876 A 1/1994 Atkins
5,316,174 A 5/1994 Schutz
5,402,915 A 4/1995 Hogan
5,673,896 A 10/1997 Gillen
6,050,545 A 4/2000 Stolzman
6,056,012 A 5/2000 Yuen et al.
6,079,587 A 6/2000 Vogt
6,247,594 B1 * 6/2001 Garton ..... B65D 19/04 206/512
7,913,850 B2 3/2011 Schuetz
7,978,067 B2 7/2011 Wagner et al.
D666,691 S 9/2012 Higgins
D728,732 S 5/2015 Higgins
D777,877 S 1/2017 Higgins et al.
9,657,855 B2 5/2017 Oltman et al.
2004/0256590 A1 12/2004 Pettinaroli
2006/0174968 A1 8/2006 De Luna
2010/0327205 A1 12/2010 Tan
2013/0043203 A1 * 2/2013 Wauters ..... B65D 1/48 215/40
2013/0056472 A1 * 3/2013 Matye ..... B65B 39/06 220/500
2020/0317415 A1 * 10/2020 Spann ..... B65D 21/0215

* cited by examiner

STACKABLE BULK CONTAINER

CROSS-REFERENCE TO RELATED APPLICATIONS

This application claims the benefit of U.S. Provisional Application Ser. No. 62/852,077, filed May 23, 2019, entitled POLY IBC BOTTLE AND BALL VALVE, which is hereby incorporated in its entirety by reference herein.

This application is being filed contemporaneously with U.S. Utility Application Ser. No. 16/810,297, entitled BULK CONTAINER WITH BOTTOM CONFIGURED FOR DRAINAGE, and U.S. Utility Application Ser. No. 16/810,361, entitled BULK CONTAINER WITH QUICK-COUPLE LID, U.S. Design Application No. 29/726,799, entitled CONTAINER AND PALLET, U.S. Design Application No. 29/726,803, entitled CONTAINER, and U.S. Design Application No. 29/726,808, entitled CONTAINER, each of which is hereby incorporated in its entirety by reference herein.

BACKGROUND

1. Field

The present invention relates generally to containers. More specifically, embodiments of the present invention concern a stackable container system for intermediate bulk containers.

2. Discussion of Prior Art

Intermediate bulk containers are well known in the art for their use in shipping bulk quantities of liquid and solid materials. Conventional containers include a receptacle with a continuous wall construction. Known intermediate bulk containers are generally designed to be stacked on top of one another. Prior art containers include intermediate bulk containers constructed of various materials, such as metallic materials and polymers.

However, conventional intermediate bulk containers have several deficiencies. For instance, known bulk containers drain poorly and generally have low spots that restrict liquid and/or solid materials contained therein from being drained completely. Prior art containers designed for stacking commonly have structural weaknesses that unduly limit stacking loads and/or limit container storage capacity. Conventional bulk containers also have container lids that are time-consuming to install or remove. It is also known for lids of such containers to be inadvertently displaced from the receptacle under extreme conditions (e.g., when the container is over-pressurized).

This background discussion is intended to provide information related to the present invention which is not necessarily prior art.

SUMMARY

The following brief summary is provided to indicate the nature of the subject matter disclosed herein. While certain aspects of the present invention are described below, the summary is not intended to limit the scope of the present invention.

Embodiments of the present invention provide a container that does not suffer from the problems and limitations of the prior art devices, including those set forth above.

One aspect of the present invention concerns a stackable container system configured to provide stacked receptacles for receiving bulk material therein. The stackable container system broadly includes a first receptacle configured to provide a respective stacked receptacle and includes a receptable bottom, a receptable top, and a receptacle side extending along an upright container axis between the receptacle bottom and top, with the first receptacle presenting a container chamber. The receptacle top is configured to at least partly support another one of the stacked receptacles stacked relative thereto along the upright container axis. The receptacle top and the receptacle side have, respectively, a top peripheral margin and a side peripheral margin that extend laterally about the upright container axis, with at least part of the top peripheral margin being laterally outboard of the side peripheral margin. At least part of the top peripheral margin is interconnected to the side peripheral margin along a transition section that extends laterally between the receptacle top and the receptacle side.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
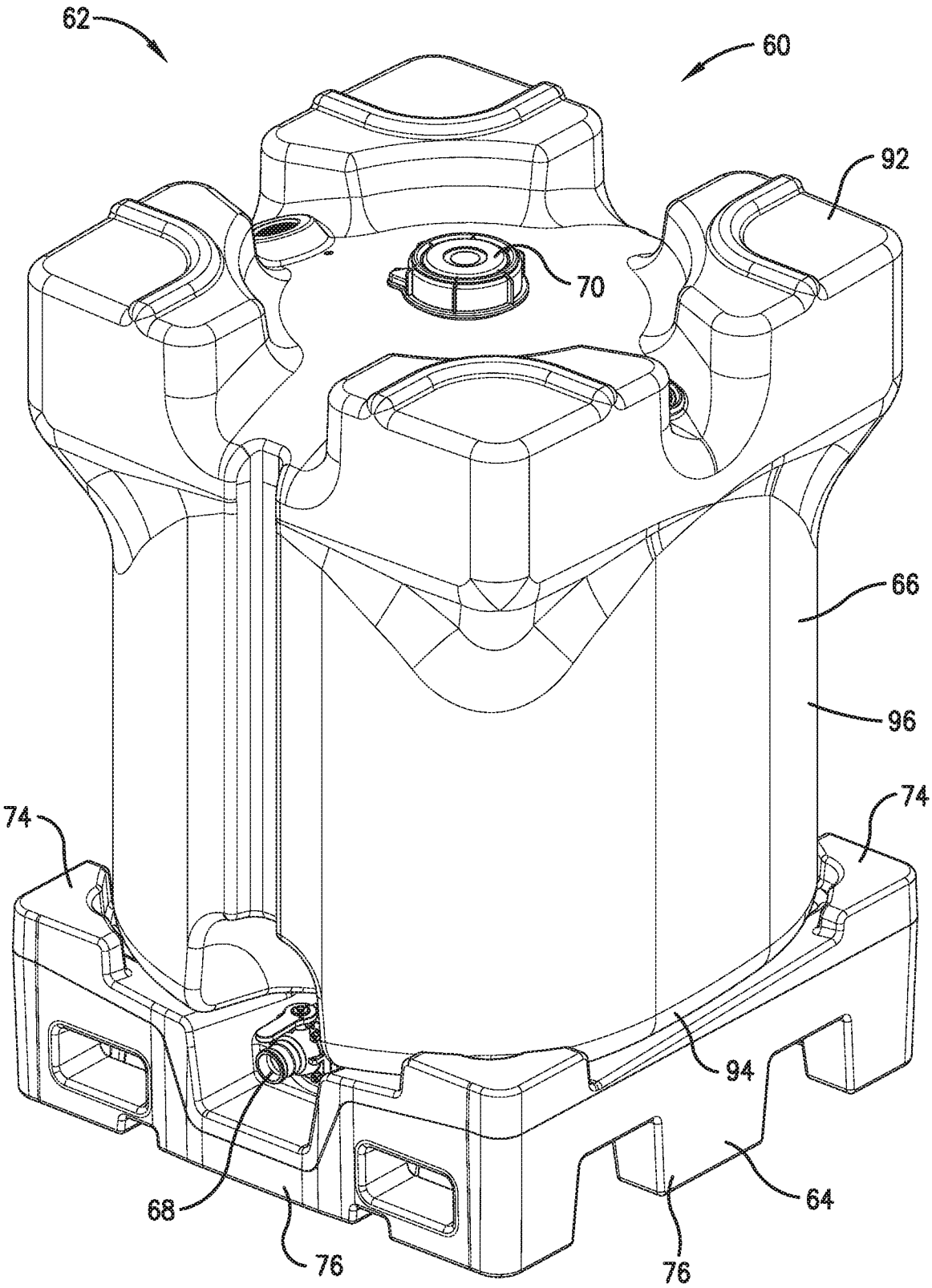
FIGS. 1-4 are perspective views of a container constructed in accordance with a preferred embodiment of the present invention, showing a receptacle, pallet, and lid of the container.
Figure 2:
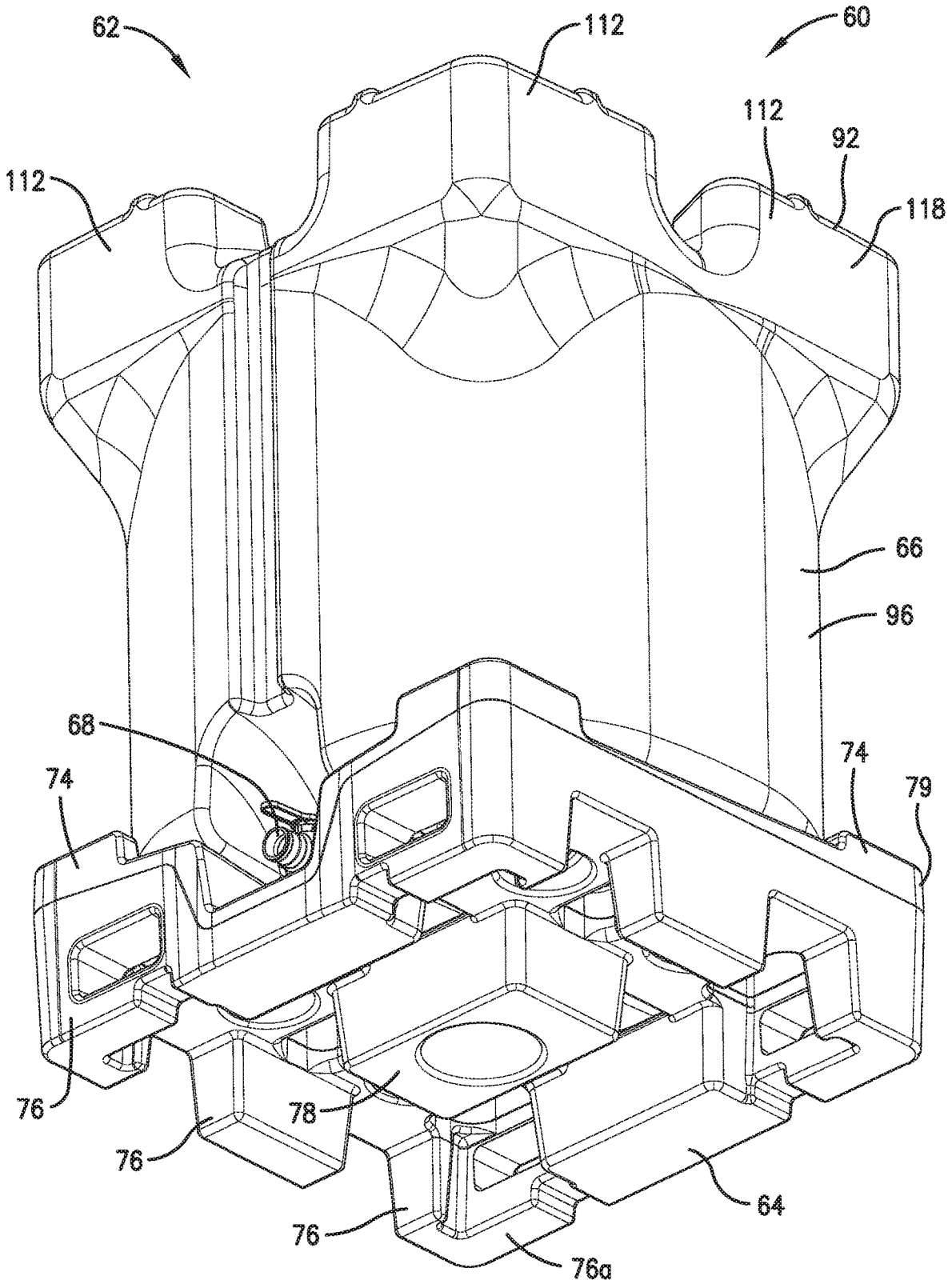

The drawing figures do not limit the present invention to the specific embodiments disclosed and described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION OF THE PREFERRED EMBODIMENTS

Turning to FIGS. 1-4, an intermediate bulk container 60 is configured to receive a bulk material for material management (e.g., for storage and/or transport of the material). The material (not shown) is preferably in a liquid form. However, it will be appreciated that alternative and preferred embodiments of the container may be operable to hold bulk material in forms other than liquid. For instance, at least some of the contained material may be solid (e.g., in powered or pelletized form). It will also be understood that at least some of the contained material may at least partly assume a vapor or gaseous form.

Figure 18:
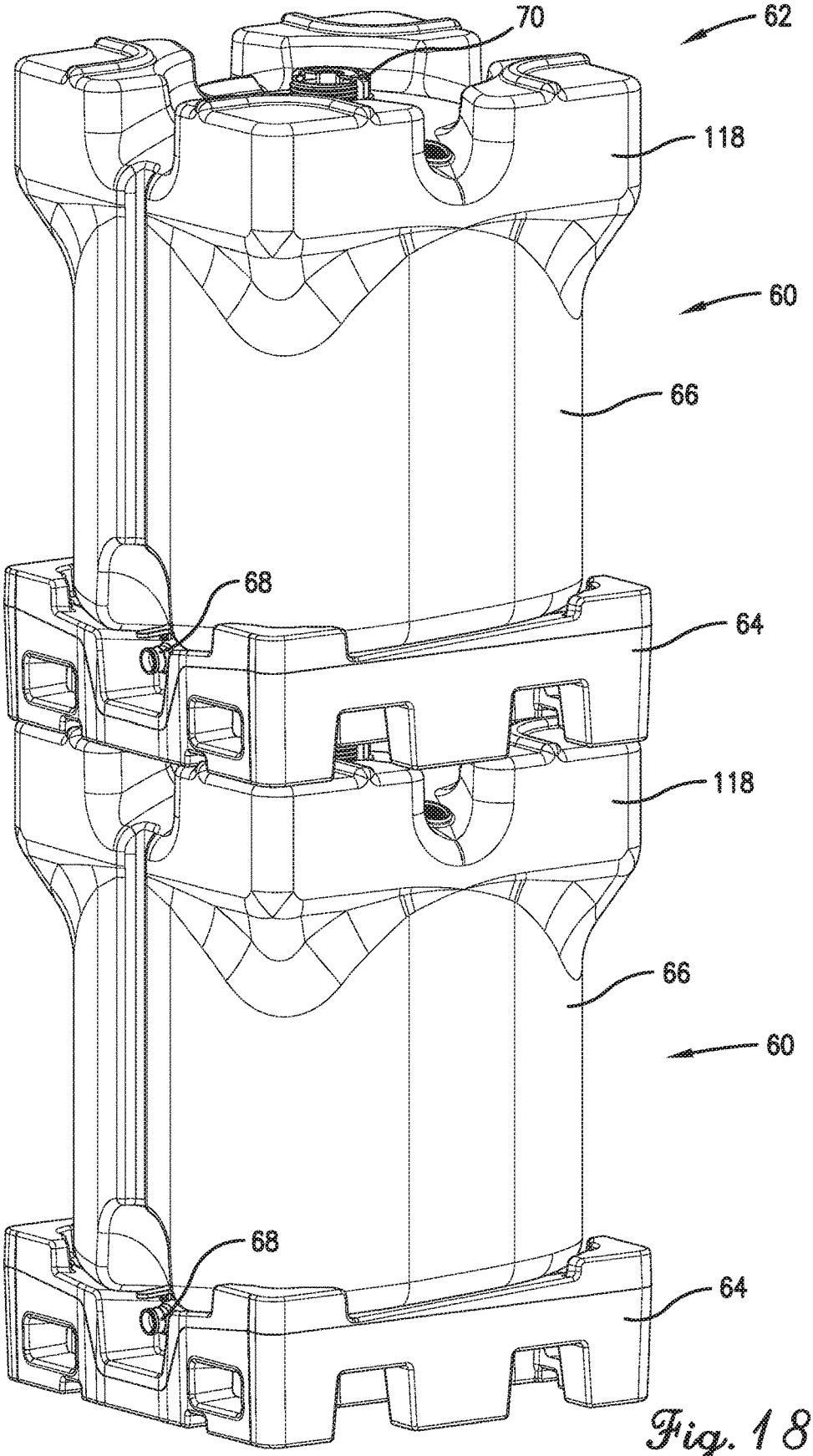
FIG. 18 is an upper perspective showing a stacked container system including a pair of containers as shown in FIGS. 1-10.
Figure 19:
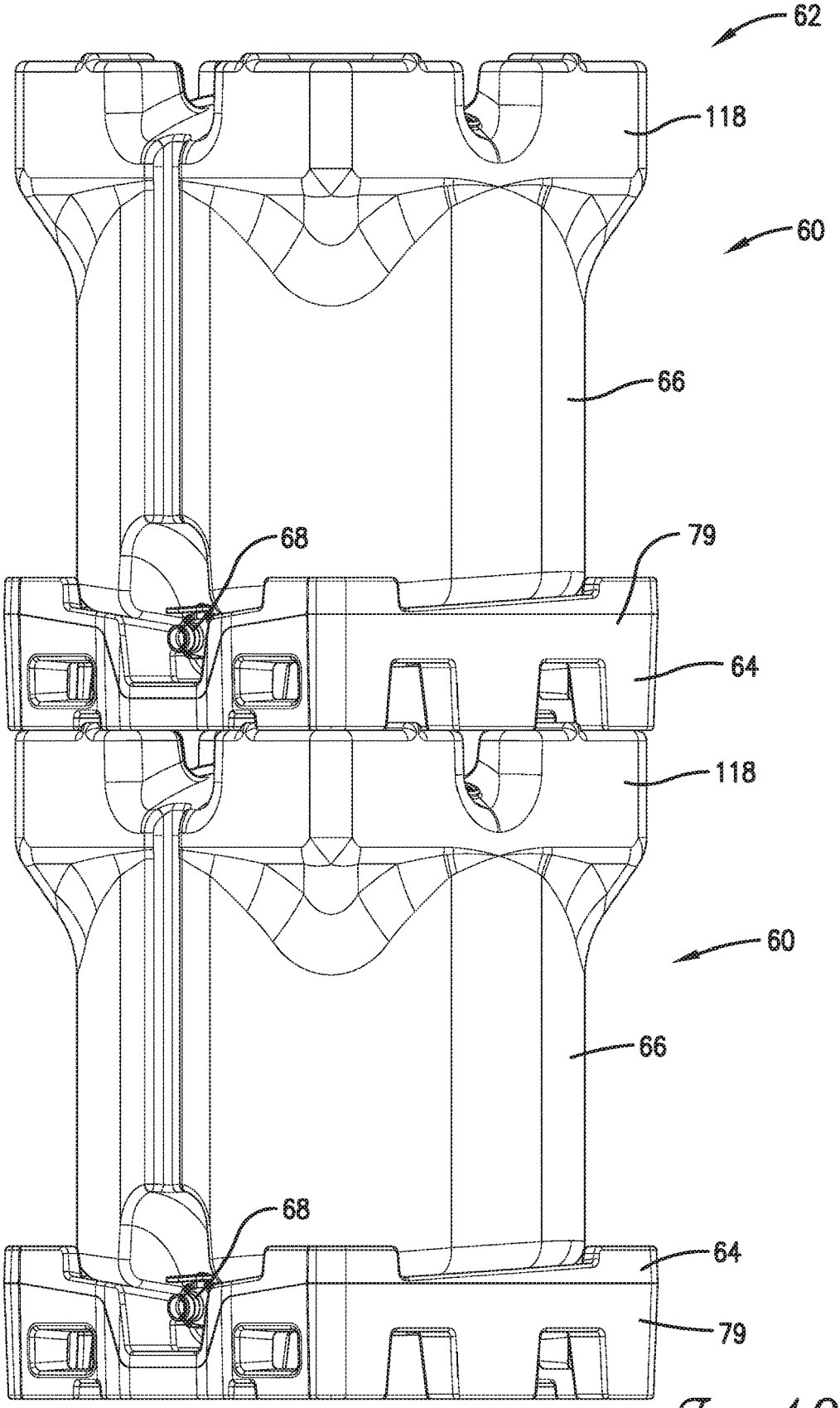
FIG. 19 is a perspective of the stacked container system shown in FIG. 18.

The container 60 is preferably configured so that multiple containers 60 can be stacked on top of one another to provide a stackable container system 62 (see FIGS. 18 and 19). The depicted container 60 preferably includes a pallet 64, receptacle 66, valve assembly 68, and a lid 70.

Turning to FIGS. 1-6 and 23-31, the pallet 64 is configured to support the receptacle 66, whether the receptable 66 is stored on a floor surface, stacked on another receptacle 66, or stacked on another elevated surface. The pallet 64 is preferably configured to conform to a bottom of the receptacle 66 for supporting the receptacle 66, as will be explained in greater detail. Features of the pallet 64 also preferably support engagement with a forklift (not shown) for lifting the container 60 above a floor surface or other support surface.

The illustrated pallet 64 preferably comprises a unitary structure that includes upper panels 72, locating corner tabs 74, peripheral supports 76, and central support 78. The pallet 64 also preferably has a pallet peripheral margin 79 with a generally square profile shape. The pallet peripheral margin 79 is generally shaped to conform to the peripheral shape of the top of the receptacle 66.

Figure 23:
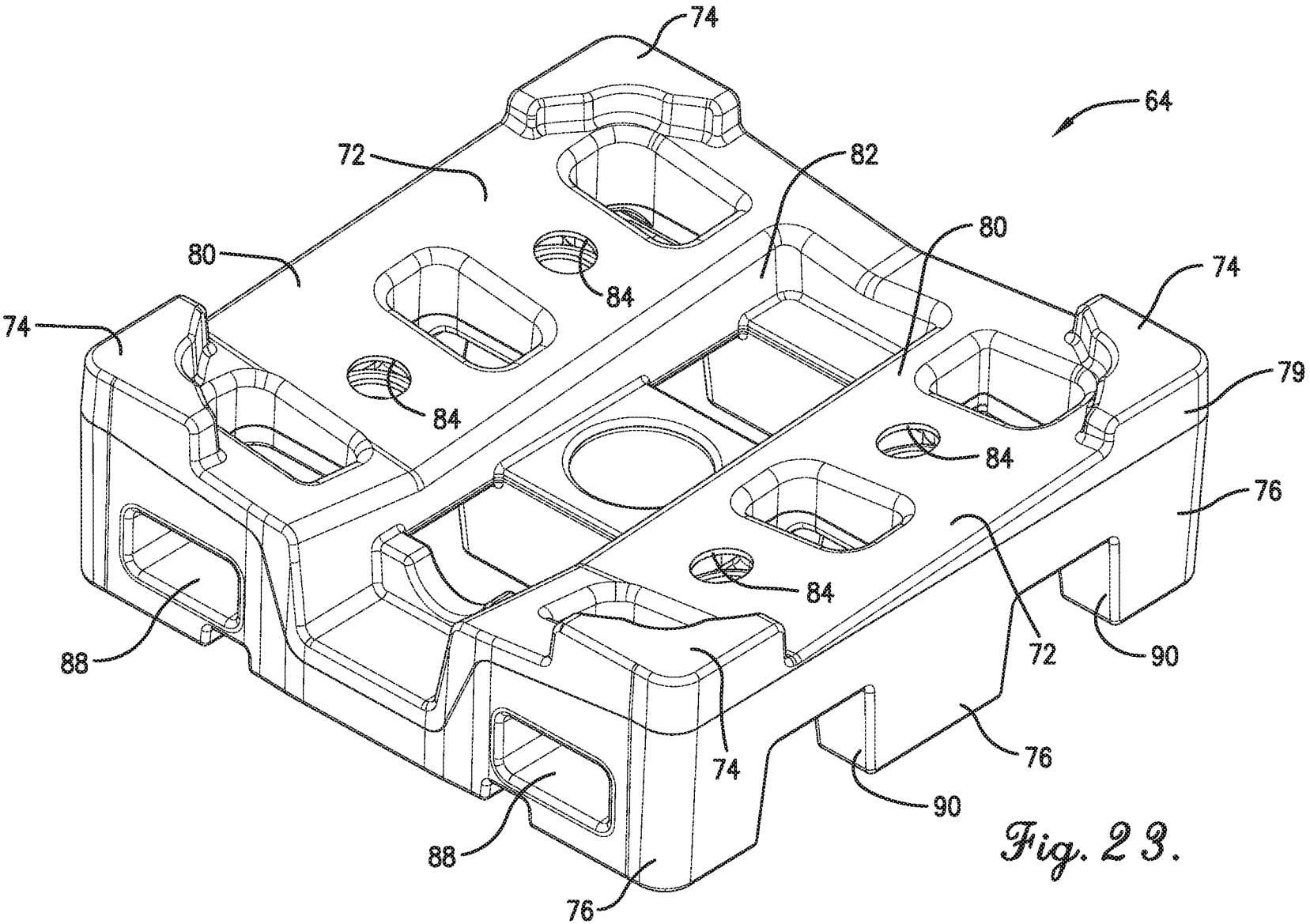
FIGS. 23-31 are views of the pallet shown in FIGS. 1-10.
Figure 24:
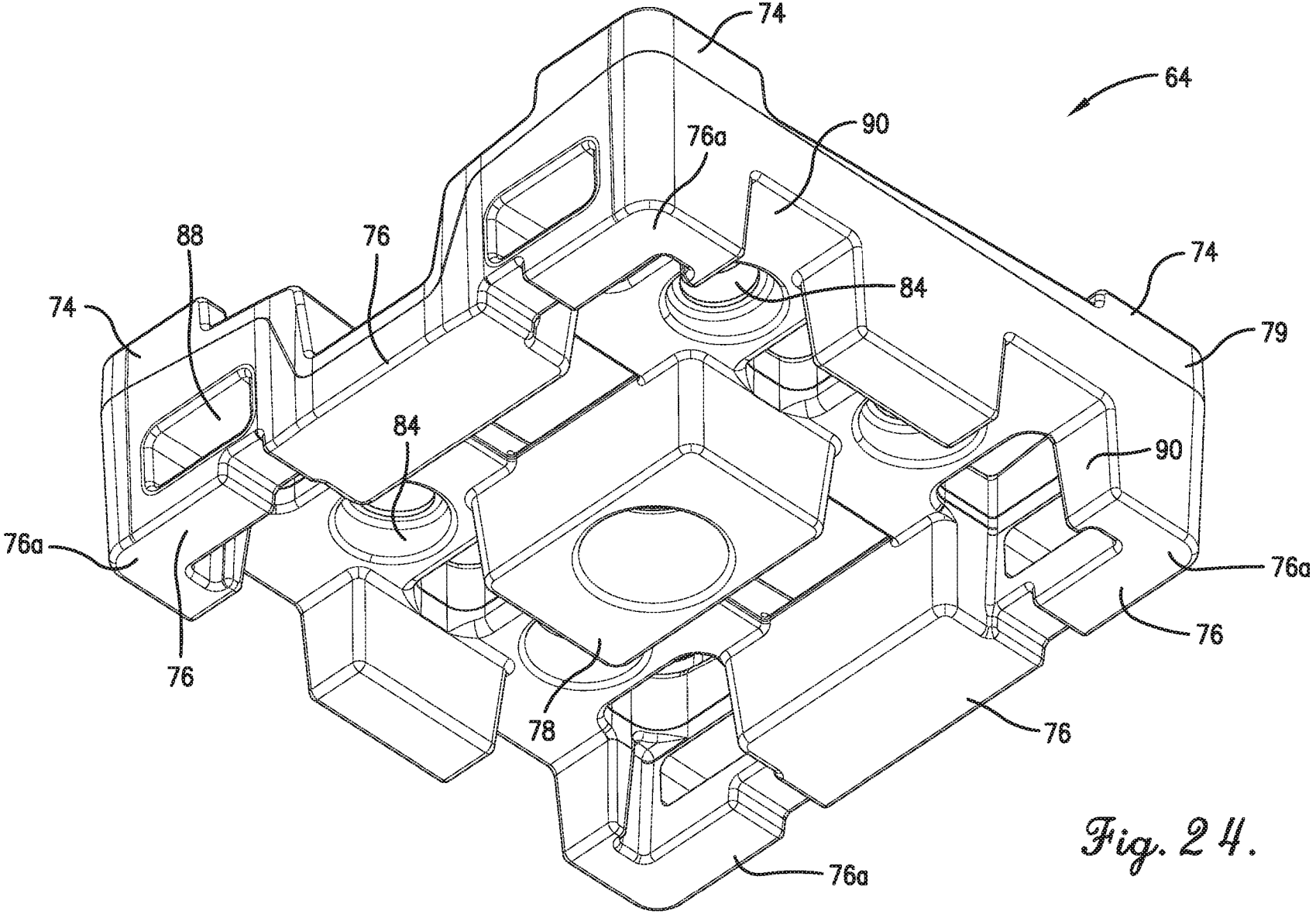
Figure 25:
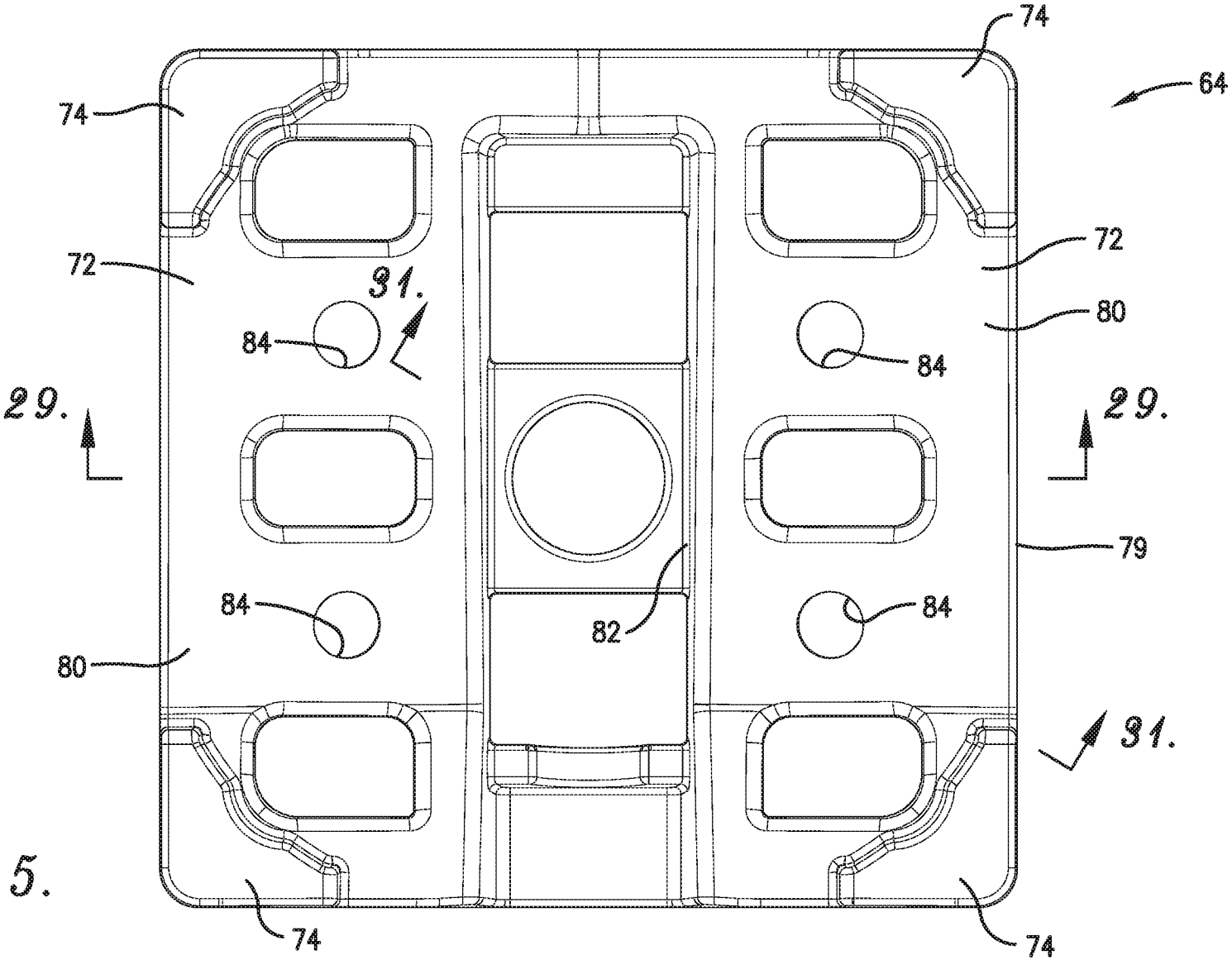
Figure 26:
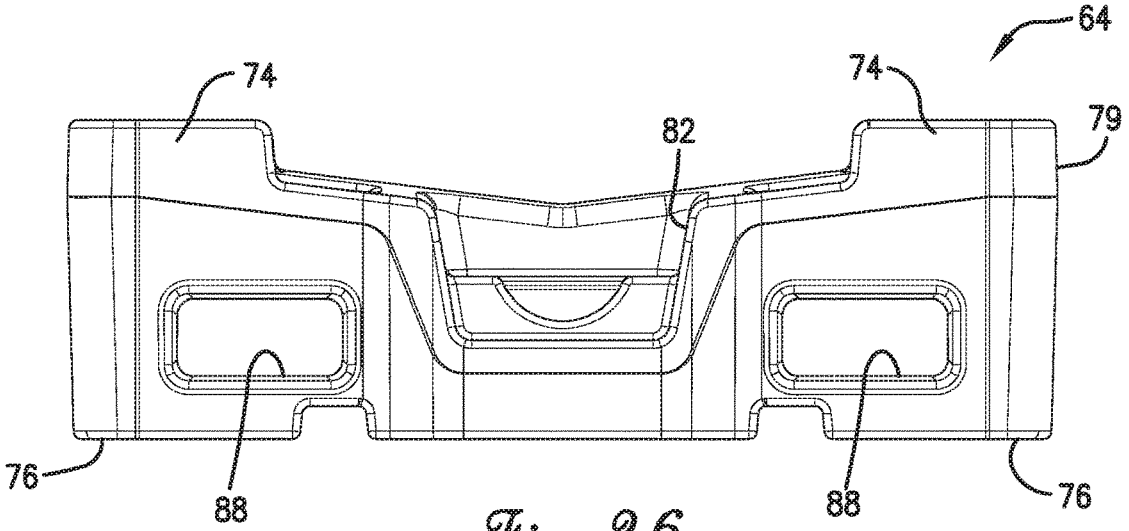
Figure 27:
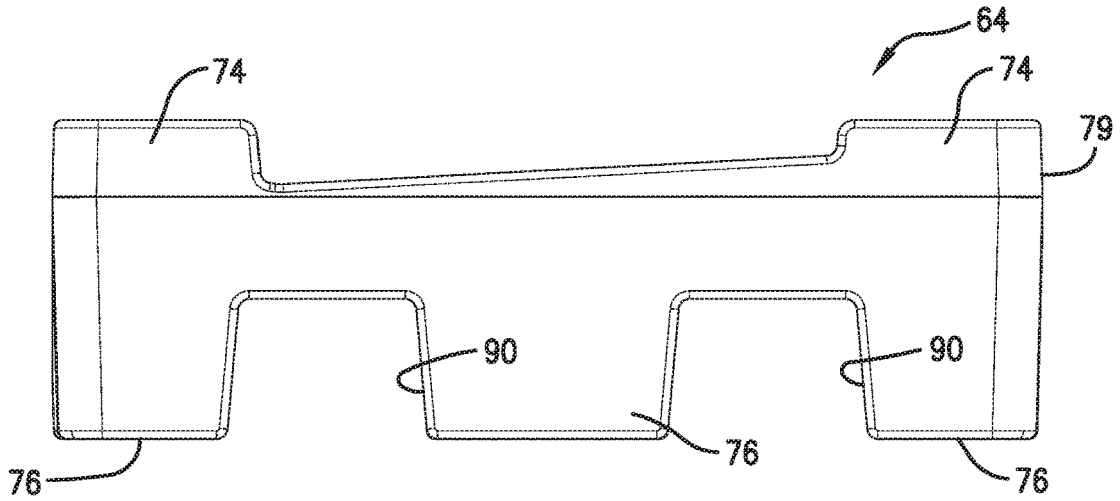
Figure 28:
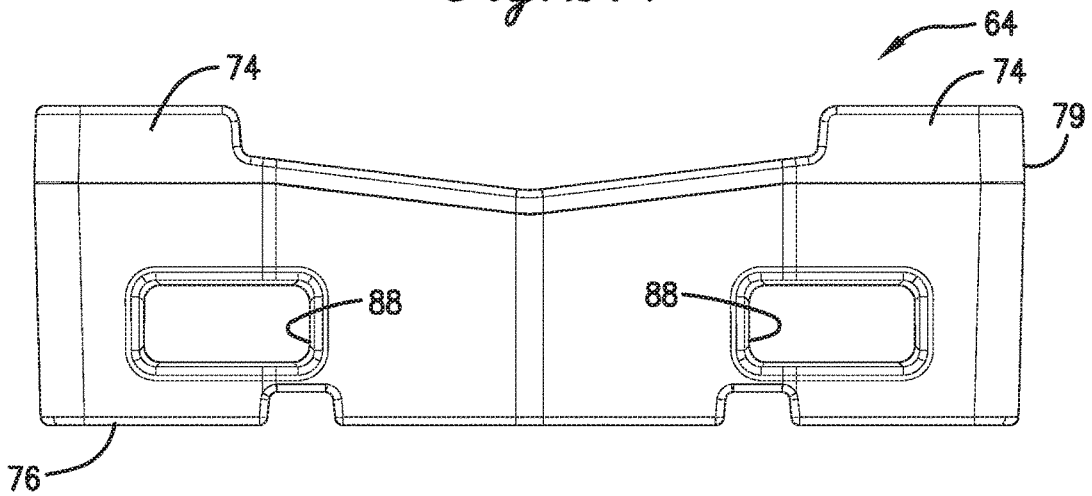
Figure 29:
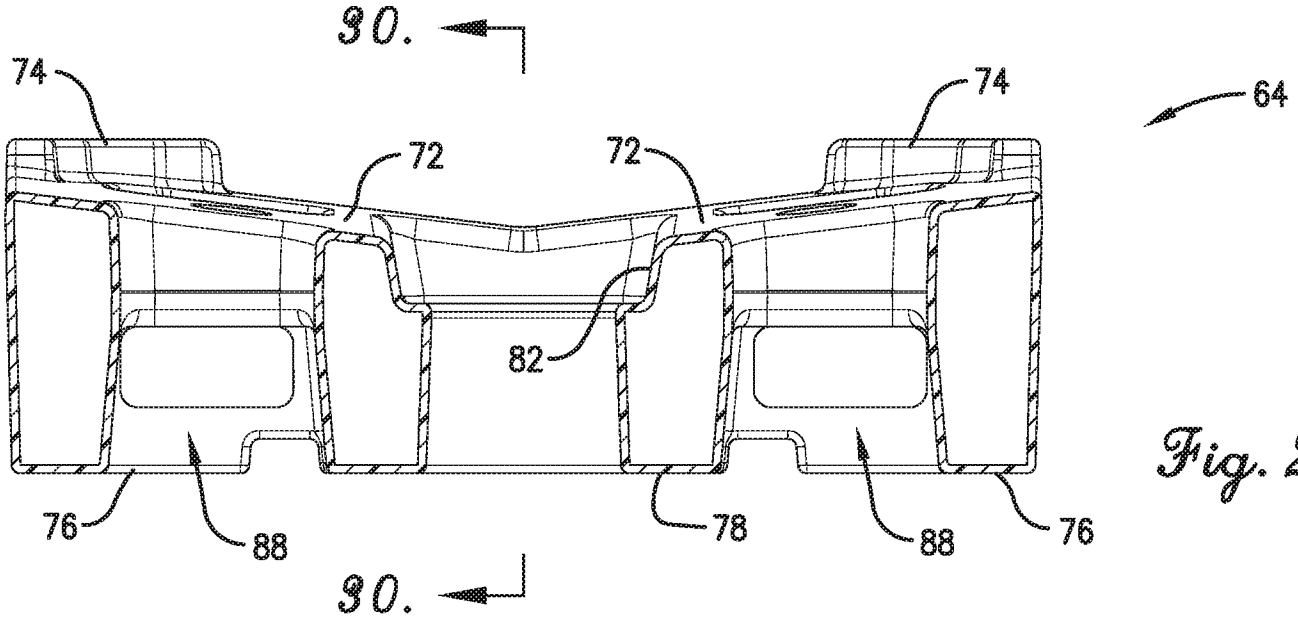
Figure 30:
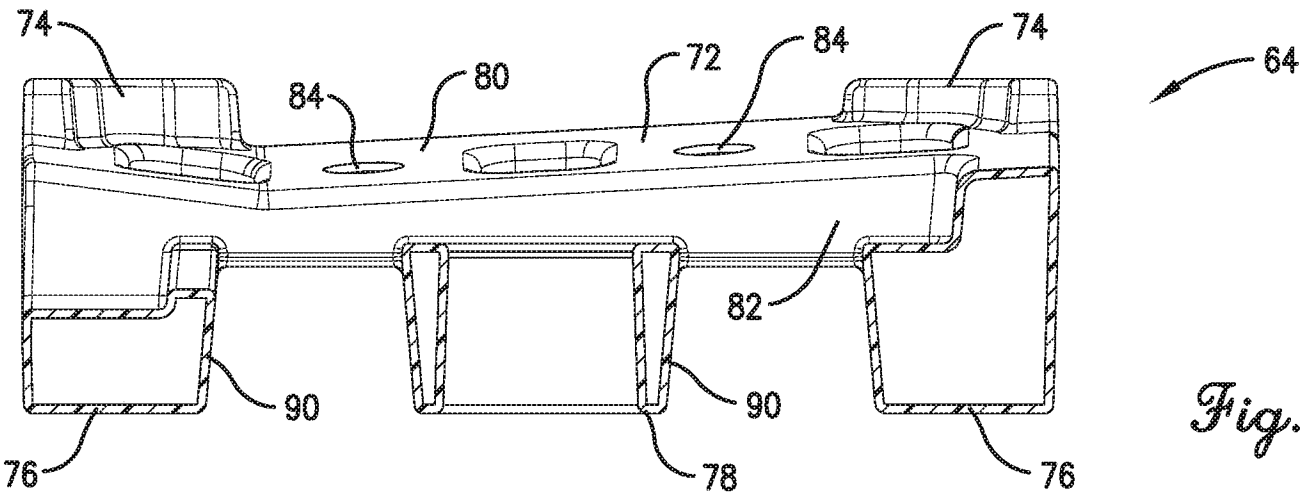
Figure 31:
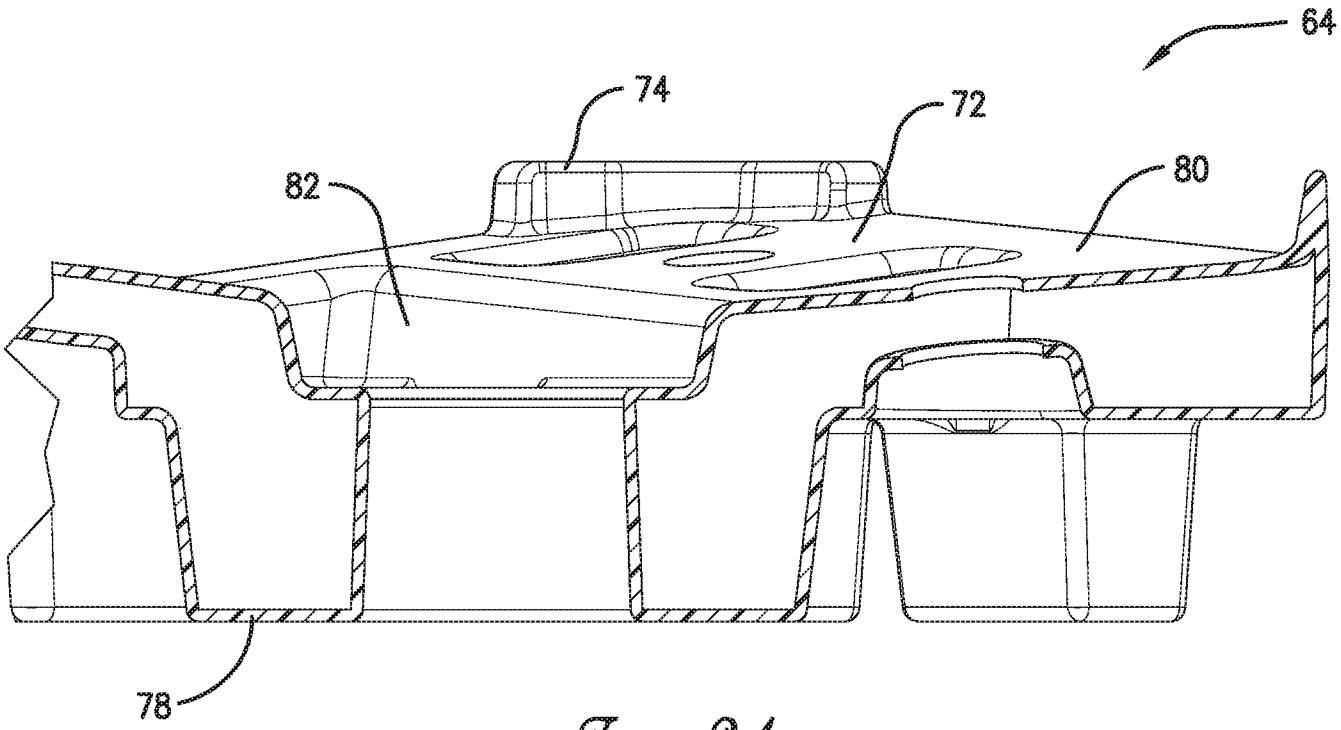

The upper panels 72 present respective support surfaces 80 (see FIG. 23). As will be explained, the support surfaces 80 are configured to be positioned in conformity with corresponding surfaces presented by the bottom of the receptacle 66 (see FIG. 6). The pallet 64 also presents a channel 82 that extends laterally between the upper panels 72 (see FIG. 23). The support surfaces 80 are configured to engage the bottom of the receptacle 66 when the receptacle 66 is supported on the pallet 64. The support surfaces 80 preferably conform to respective parts of the receptacle bottom.

The pallet 64 further presents fastener openings 84 extending vertically through the upper panels 72 (see FIG. 23). The fastener openings 84 are configured to receive fasteners 86 to removably secure the receptacle 66 to the pallet 64 (see FIGS. 3 and 6).

The supports 76,78 are configured to engage a floor surface (not shown), an elevated surface (not shown), or the top of a receptacle 66. The supports 76,78 cooperatively define elongated pairs of relief slots 88,90 (see FIG. 23) configured to receive the forks of a forklift (not shown). The supports 76 also preferably include pallet corner sections 76*a* configured to be engaged with the top of the receptacle 66, as will be explained.

The depicted pallet 64 preferably includes a synthetic resin material. In preferred embodiments, the synthetic resin material includes a polymer material, such as a high-density, polyethylene (HDPE) material. The HDPE material is preferably formulated with a UV inhibitor to facilitate extended outdoor usage. However, it is also within the ambit of the present invention for alternative pallet embodiments to include an alternative polymer.

The depicted pallet 64 preferably comprises a molded structure and is preferably molded using a roto-mold manufacturing process. It is also within the scope of the present invention for at least part of the pallet to be formed by an alternative manufacturing method (e.g., an alternative molding procedure, such as injection molding).

For at least some aspects of the present invention, the pallet could have an alternative configuration. For instance, the upper panels of the pallet could be alternatively shaped for conforming engagement with the bottom of the receptacle. It is also within the scope of the present invention for the container to be provided without a pal let. Yet further, it will be appreciated that features of the pallet could be integrally formed as part of the receptacle to facilitate receptacle stacking. For instance, alternative receptacle embodiments may be configured for stacking multiple receptacles directly on top of one another.

Figure 11:
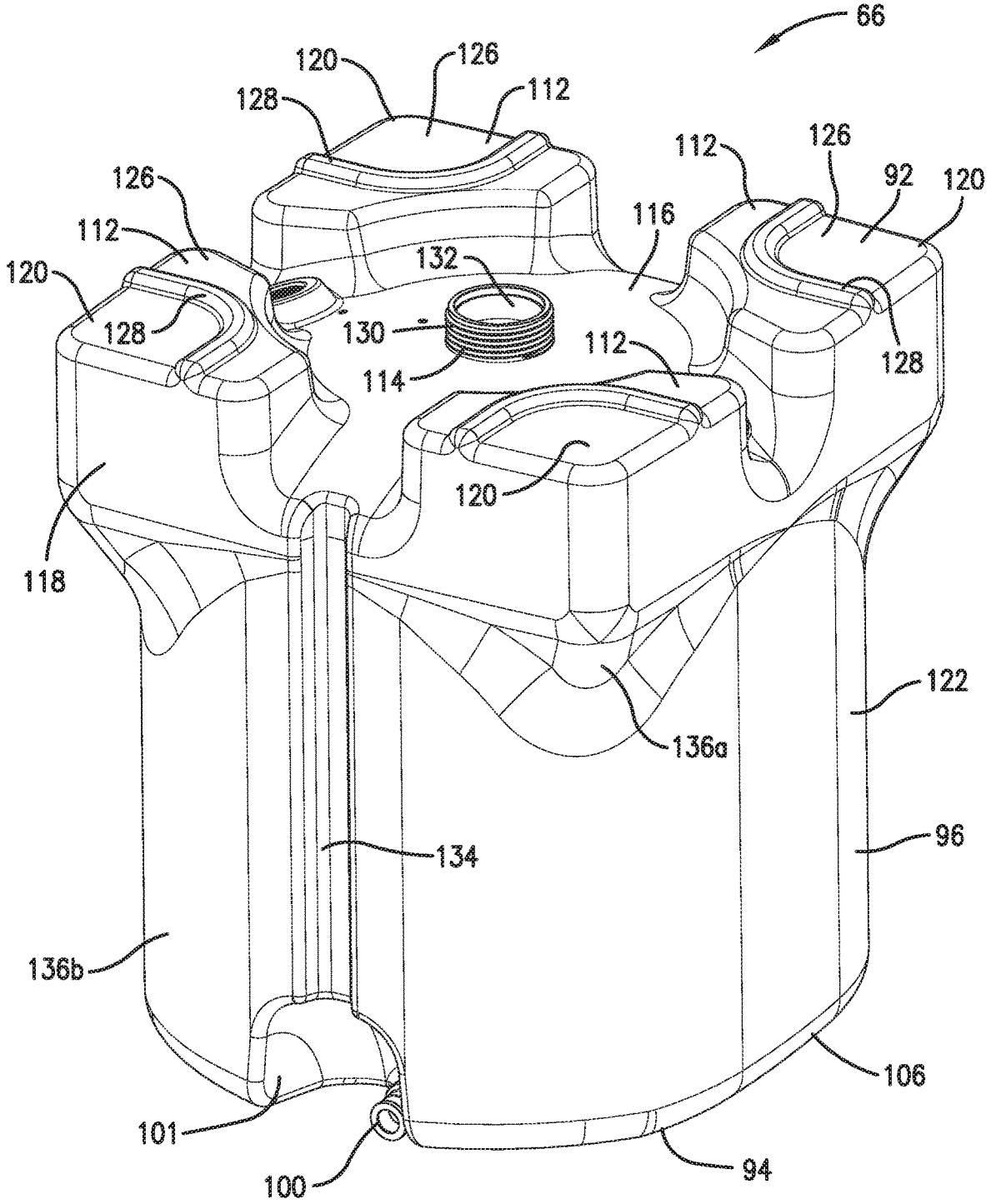
FIG. 11 is an upper front perspective of the receptacle shown in FIGS. 1-10, with the receptacle including a receptacle top, a receptacle bottom, a receptacle side, and a drain.

Turning to FIGS. 1-17, the receptacle 66 is operable to receive bulk material therein for material management (e.g., for storage and/or transport of the material). In the illustrated embodiment, the receptacle 66 preferably includes a receptacle top 92, a receptacle bottom 94, and a receptacle side 96 (see FIGS. 11 and 12). The side 96 extends continuously along an upright container axis A1 (see FIGS. 13, 14, and 16) between the receptacle top 92 and bottom 94. The top 92, bottom 94, and side 96 cooperate with the lid 70 to define a container chamber 98 (see FIG. 14). Yet further, the receptacle 66 preferably includes a drain 100 that fluidly communicates with the chamber 98 and a curved wall section 101 that overlies the drain 100.

Turning to FIGS. 11-17, the bottom 94 preferably includes floor sections 102,104 and a bottom peripheral margin 106. The floor sections 102,104 extend inboard from the peripheral margin 106 and are joined relative to each other along a pair of gutter areas 108*a* adjacent the drain 100 (see FIGS. 12 and 17). The side 96 is preferably attached to the bottom 94 along the peripheral margin 106 and extends upwardly relative to the bottom 94 along the upright container axis A1.

The drain 100 is configured to permit material flow out of the chamber 98. The drain 100 intersects the bottom 94 to define a drain opening 110 that fluidly communicates with the chamber 98 (see FIG. 14). The drain opening 110 is spaced inboard from the peripheral margin 106 and is laterally offset from the container axis A1 in an offset direction D1 (see FIG. 14). As will be explained, the bottom 94 is preferably configured to facilitate optimal draining of material from the chamber 98.

The receptacle top 92 is configured to at least partly support another receptacle 66 stacked relative thereto along the upright container axis A1 (see FIGS. 18 and 19). In the illustrated embodiment, the receptacle top 92 preferably includes multiple pillars 112, a fill neck 114, and top wall 116 extending between the pillars 112 and the fill neck 114 (see FIGS. 11-17).

The depicted receptacle top 92 has a top peripheral margin 118 that extends laterally, about the upright container axis A1. The top peripheral margin 118 of the receptacle top 92 has a generally square profile shape, although the margin could be alternatively shaped. The receptacle top 92 has top corner sections 120 that define at least part of the top peripheral margin 118 and are laterally outboard from a side peripheral margin 122 of the side 96 (see FIGS. 11-17). Preferably, the corner sections 120 of the receptacle 66 are operable to support a stacked receptacle when stacked relative thereto (see FIGS. 18 and 19).

In the depicted embodiment, the pillars 112 are spaced apart from one another, and the fill neck 114 is located between the pillars 112. The pillars 112 are located at least partly above the fill neck 114. The pillars 112 preferably form the corner sections 120 of the receptacle top 92. The corner sections 120 are laterally outboard from the side peripheral margin 122 to support the stacked receptacle. However, it is contemplated by some aspects of the present invention for the corner sections to be provided by structure other than the depicted pillars. In alternative embodiments, the corner sections could be alternatively configured and/or positioned relative to other features of the receptacle.

Each pillar 112 includes a hollow structure 124 that defines a respective part of the container chamber 98. The pillars 112 each preferably present an upper pillar surface 126 with a locating rib 128 to facilitate stacking of another container 60 (see FIG. 11). In particular, the upper pillar surfaces 126 associated with the top corner sections 120 are configured to cooperatively engage pallet corner sections 76*a* presented by the supports 76 when a pallet 64 is positioned on the receptacle top 92.

The fill neck 114 is configured to receive the lid 70 and includes a threaded tube 130 that presents a fill opening 132 (see FIGS. 11-17). The lid 70 is operable to be removably secured to the fill neck 114 in an engaged condition to close the fill opening 132 (see FIGS. 9 and 10).

The receptacle side 96 preferably extends continuously along the upright container axis A1 to interconnect the receptacle top 92 and bottom 94. The receptacle side 96 comprises a continuous side wall. The depicted side 96 preferably includes a pair of ribs 134 extending vertically along the container axis A1 (see FIGS. 11-17).

Figure 16:
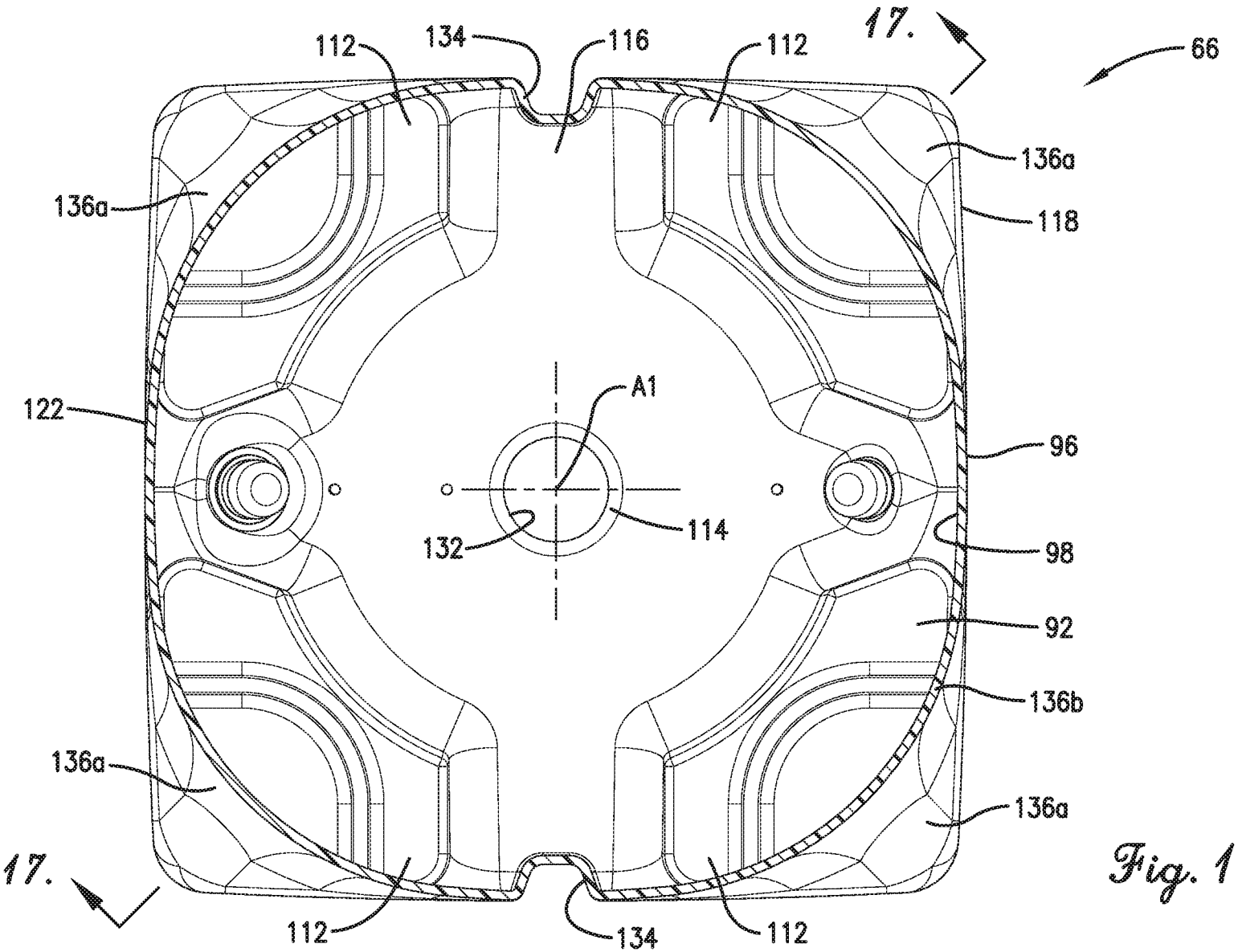
FIG. 16 is a cross section of the receptacle taken along line 16-16 in FIG. 13, depicting the shape of the receptacle side.
Figure 17:
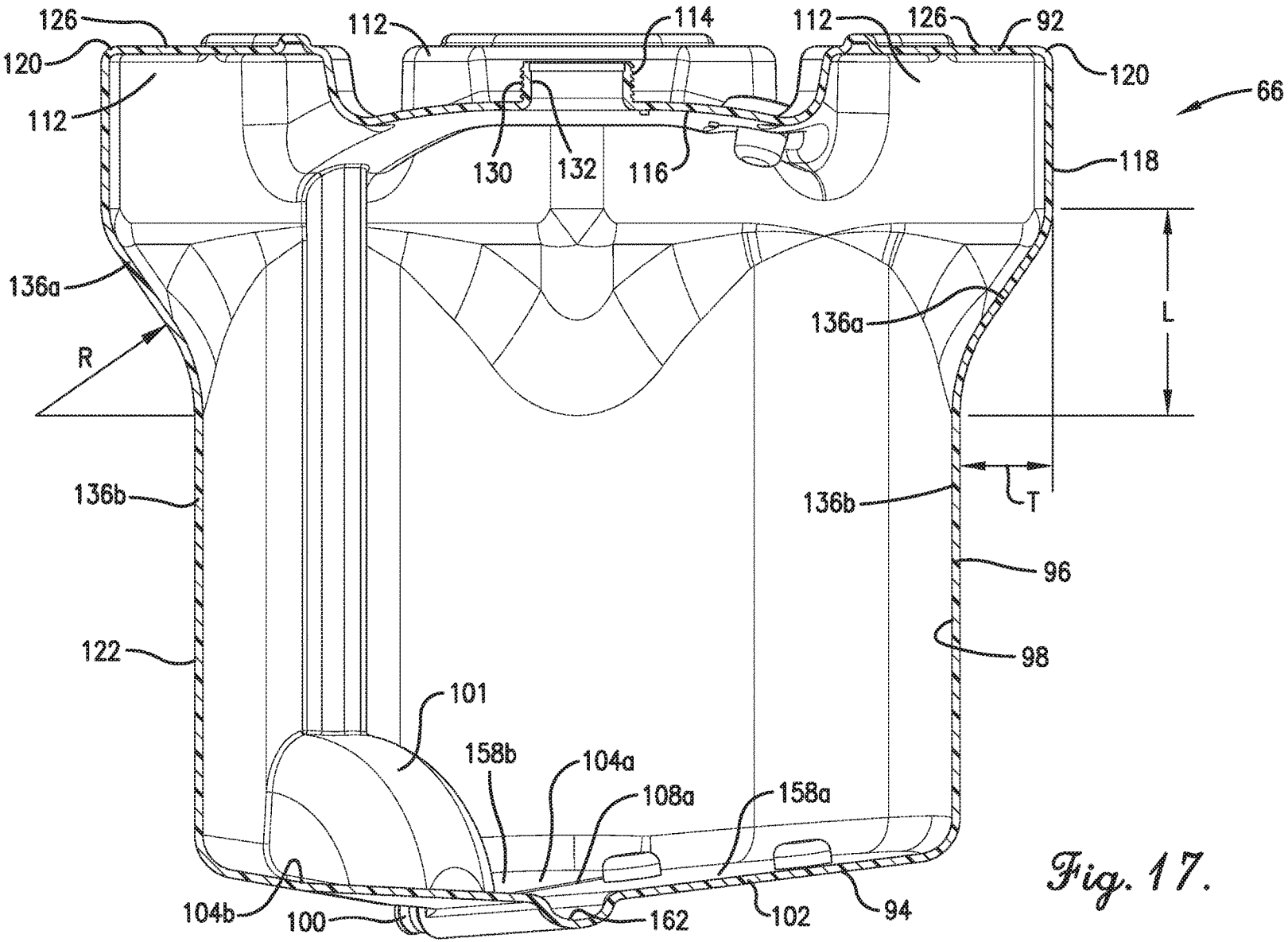
FIG. 17 is a cross section of the receptacle taken along line 17-17 in FIG. 16, illustrating the configuration of a transition section that interconnects the receptacle top and the receptacle side.

In the depicted embodiment, the side peripheral margin 122 extends laterally about the upright container axis A1 (see FIG. 16). The receptacle side 96 is shaped so that the side peripheral margin 122 has a generally rounded cross-sectional shape. The shape of the side peripheral margin 122 is approximately a circular profile shape in the depicted embodiment. For at least some aspects of the present invention, it will be understood that the side peripheral margin could have an alternative profile shape, such as a generally square profile shape with rounded corners.

The depicted side peripheral margin 122 is preferably positioned so that at least part of the top peripheral margin 118 is laterally outboard of the side peripheral margin 122, primarily along corners of the receptacle top 92. More specifically, the illustrated top peripheral margin 118 is interconnected to the side peripheral margin 122 along a transition section 136*a* of the side 96 (see FIGS. 11-17). The transition section 136*a* extends laterally between pillars 112 of the receptacle top 92 and a continuous, upright wall section 136*b* of the receptacle side 96.

In the depicted embodiment, the transition section 136*a* preferably has dimensions that facilitate uniform load transfer from the receptacle top 92 to the receptacle side 96. The transition section 136*a* preferably defines a transition offset dimension T and a transition length dimension L (see FIG. 17). The transition section 136*a* also presents a lower margin with a transition radius R (see FIG. 17). The transition length dimension L is preferably greater than the transition offset dimension T to restrict undue flexing of the side wall. Also, the transition radius R is preferably greater than the transition offset dimension T.

The illustrated receptacle 66 preferably includes a synthetic resin material. In preferred embodiments, the synthetic resin material comprises a polymer material, such as a high-density polyethylene (HDPE) material. The HDPE material is preferably formulated with a UV inhibitor to facilitate extended outdoor usage. However, it is also within the ambit of the present invention for alternative receptacle embodiments to include an alternative polymer.

The depicted receptacle 66 preferably comprises a molded structure and is preferably molded using a roto-mold manufacturing process. It is also within the scope of the present invention for at least part of the receptacle to be formed by an alternative manufacturing method (e.g., an alternative molding procedure, such as injection molding).

Figure 20:
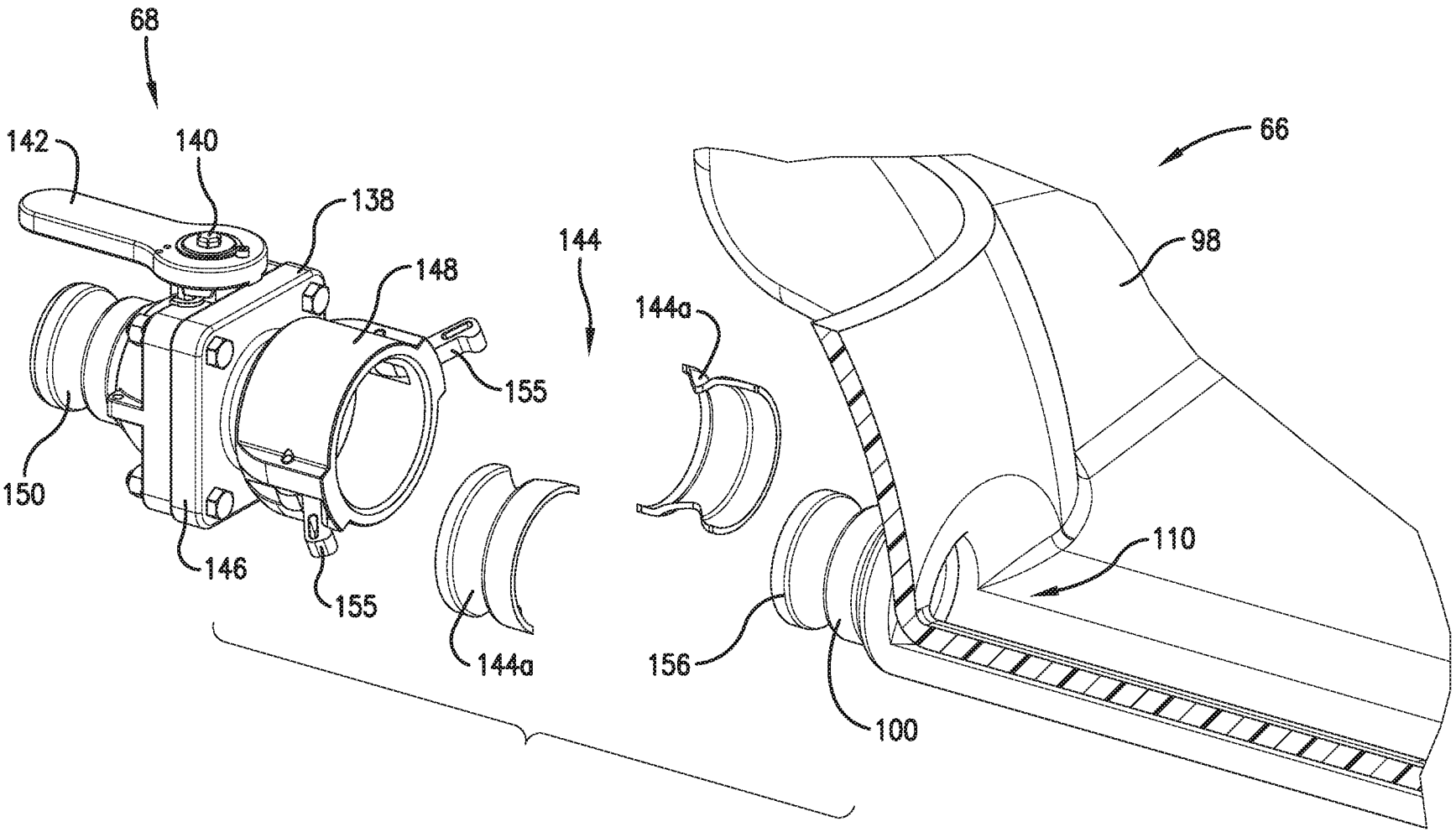
FIG. 20 is a fragmentary perspective of the container shown in FIGS. 1-10, showing a valve assembly of the container exploded from the drain.
Figure 21:
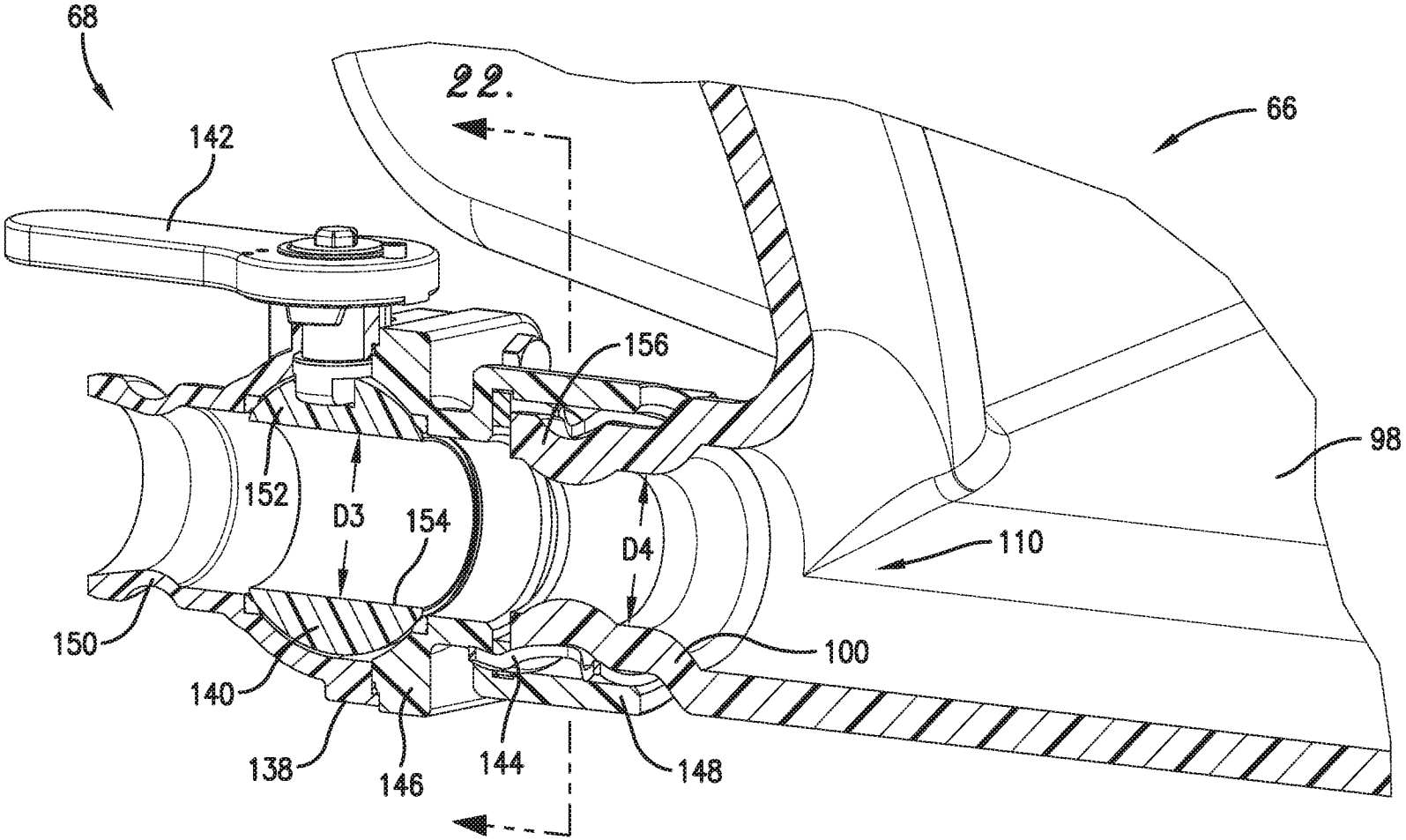
FIG. 21 is a fragmentary perspective of the container shown in FIGS. 1-10 and 20, showing the container cross-sectioned to depict a valve housing, valve, valve handle, and fitting of the valve assembly, with the valve in an open position.
Figure 22:
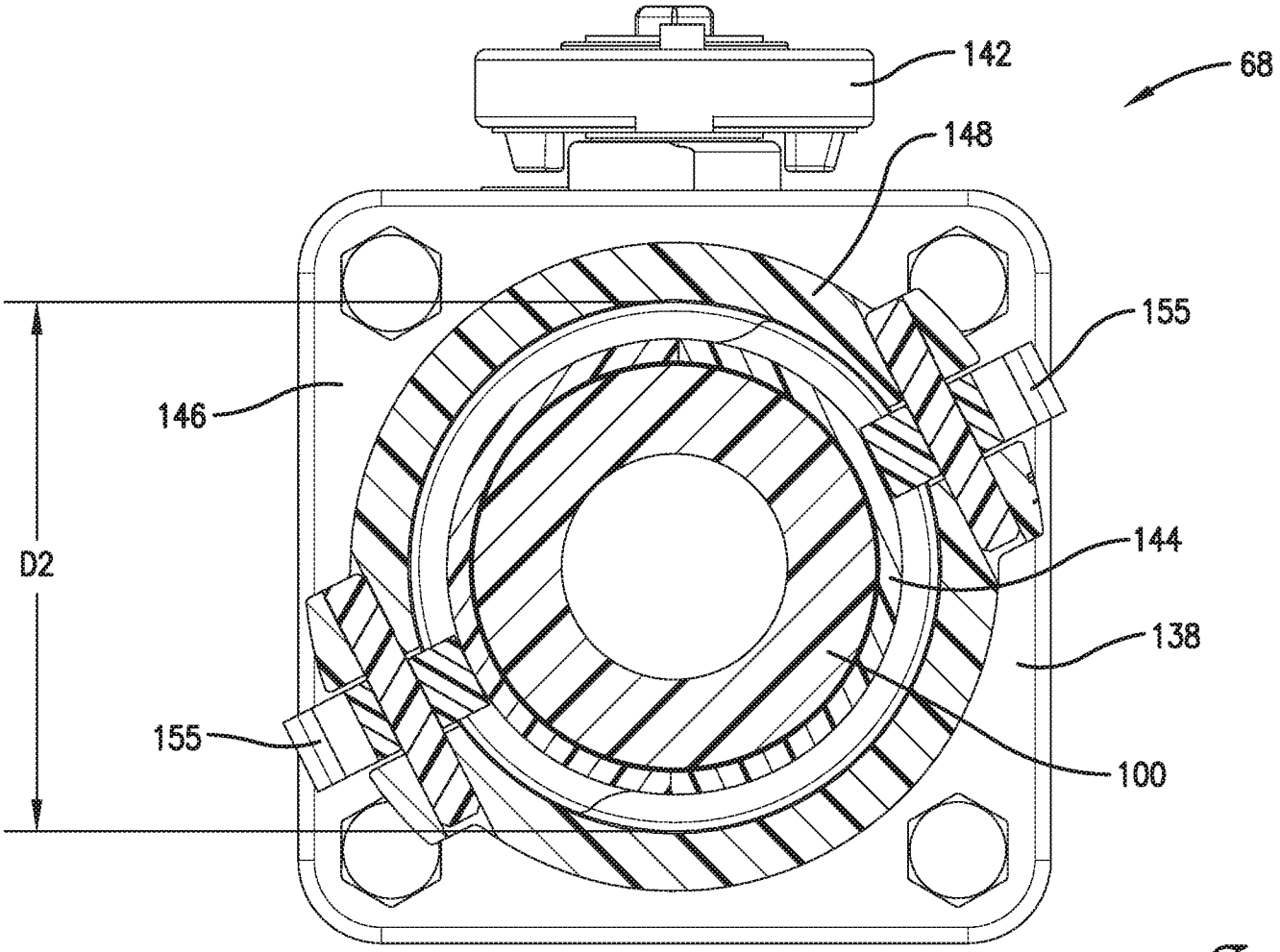
FIG. 22 is a cross section of the container taken along line 22-22 in FIG. 21, showing the drain located within an inlet coupler section of the valve housing.

Turning to FIGS. 20-22, the valve assembly 68 comprises a ball valve and is configured to communicate with the drain 100 for selectively permitting material flow out of the drain 68. The depicted valve assembly 68 includes a valve housing 138, a shiftable valve 140, a valve handle 142, and a fitting 144.

The illustrated valve housing 138 includes a body 146, an inlet coupler section 148, and an outlet section 150. The body 146 presents a chamber 152 to receive the valve 140. As is customary, the valve 140 has a generally spherical shape and presents a valve opening 154. The valve 140 is rotatable within the chamber 152 between an open position (see FIGS. 20-22) and a closed position (not shown), where the handle 142 is turned about a quarter turn from the open position.

The inlet section 148 is configured to receive an end of the drain 100 so as to minimize the flow restrictions associated with the drain 100 and ball valve. The inlet coupler section 148 includes a pair of coupler cam arms 155. The cam arms 155 are pivotally mounted to shift into and out of engagement with grooves 144*a* in the fitting 144.

In the depicted embodiment, the inlet section 148 presents an inlet diameter dimension D2 that is enlarged relative to a valve diameter dimension D3 of the valve 140. As a result, a discharge section 156 of the drain 100 received by the inlet section 148 preferably presents an interior drain diameter dimension D4 that is about the same size as the valve diameter dimension D3, It is within the scope of the present invention for the interior drain diameter dimension D4 to be about the same size or larger than the valve diameter dimension D3 (e.g., to optimize material flow out of the drain 100 and through the valve assembly 68).

The receptacle bottom 94 is preferably shaped to facilitate optimal draining of material from the chamber 98. The illustrated bottom 94 includes a pair of floor sections 102, 104 extending inboard from the bottom peripheral margin 106. As noted above, the floor sections 102,104 are joined relative to each other along the gutter areas 108*a* adjacent the drain opening 110.

Figure 14:
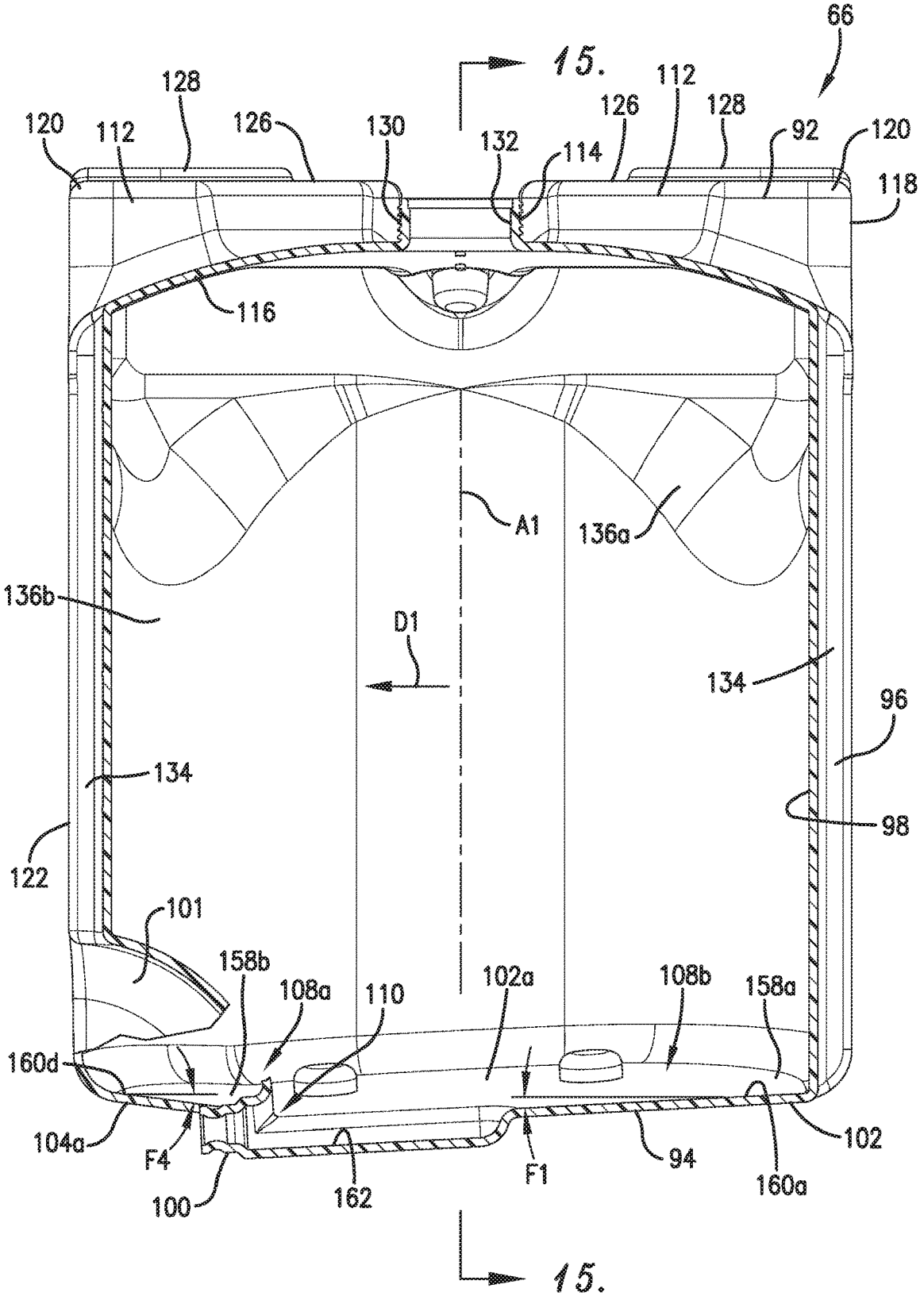
FIG. 14 is a cross section of the receptacle taken along line 14-14 in FIG. 13, showing a container chamber, opposite sloping floor sections of the receptacle bottom, and a trough that communicates with the drain.

In the depicted receptacle embodiment, the floor section 102 slopes downwardly toward the gutter area 108*a* in the offset direction D1 (see FIG. 14). The floor section 104 also preferably slopes downwardly toward the gutter area 108*a* in a direction opposite the offset direction D1 (see FIGS. 12 and 14). In this manner, the floor sections 102,104 are configured to cooperatively advance material within the chamber 98 toward the drain opening 110. Each gutter area 108*a* also preferably slopes toward the drain opening 110 in a direction transverse to the offset direction D1 (see FIGS. 12 and 17).

Figure 12:
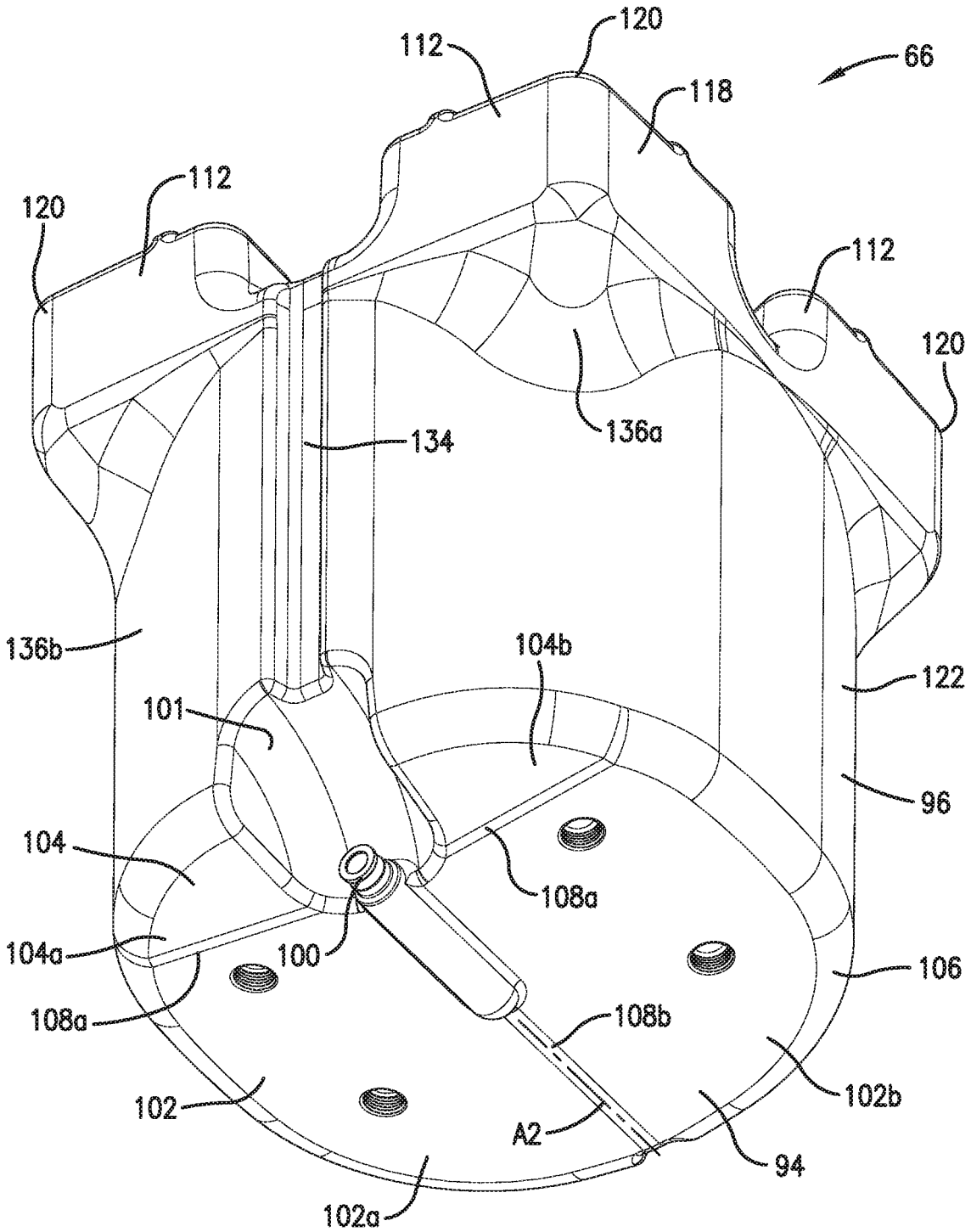
FIG. 12 is a lower front perspective of the receptacle shown in FIGS. 1-11, showing the configuration of the receptacle bottom.
Figure 13:
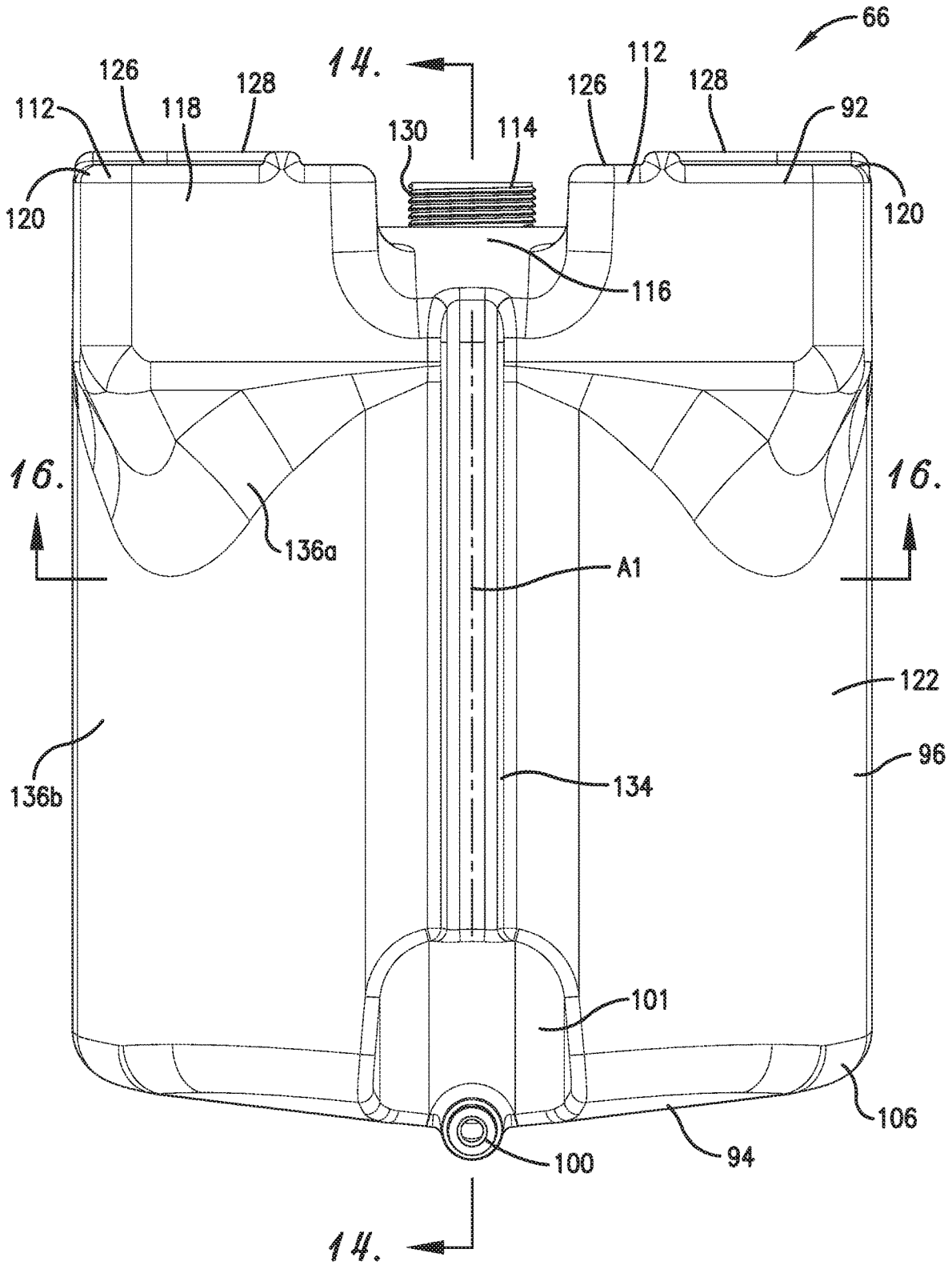
FIG. 13 is a front elevation of the receptacle shown in FIGS. 1-12.
Figure 15:
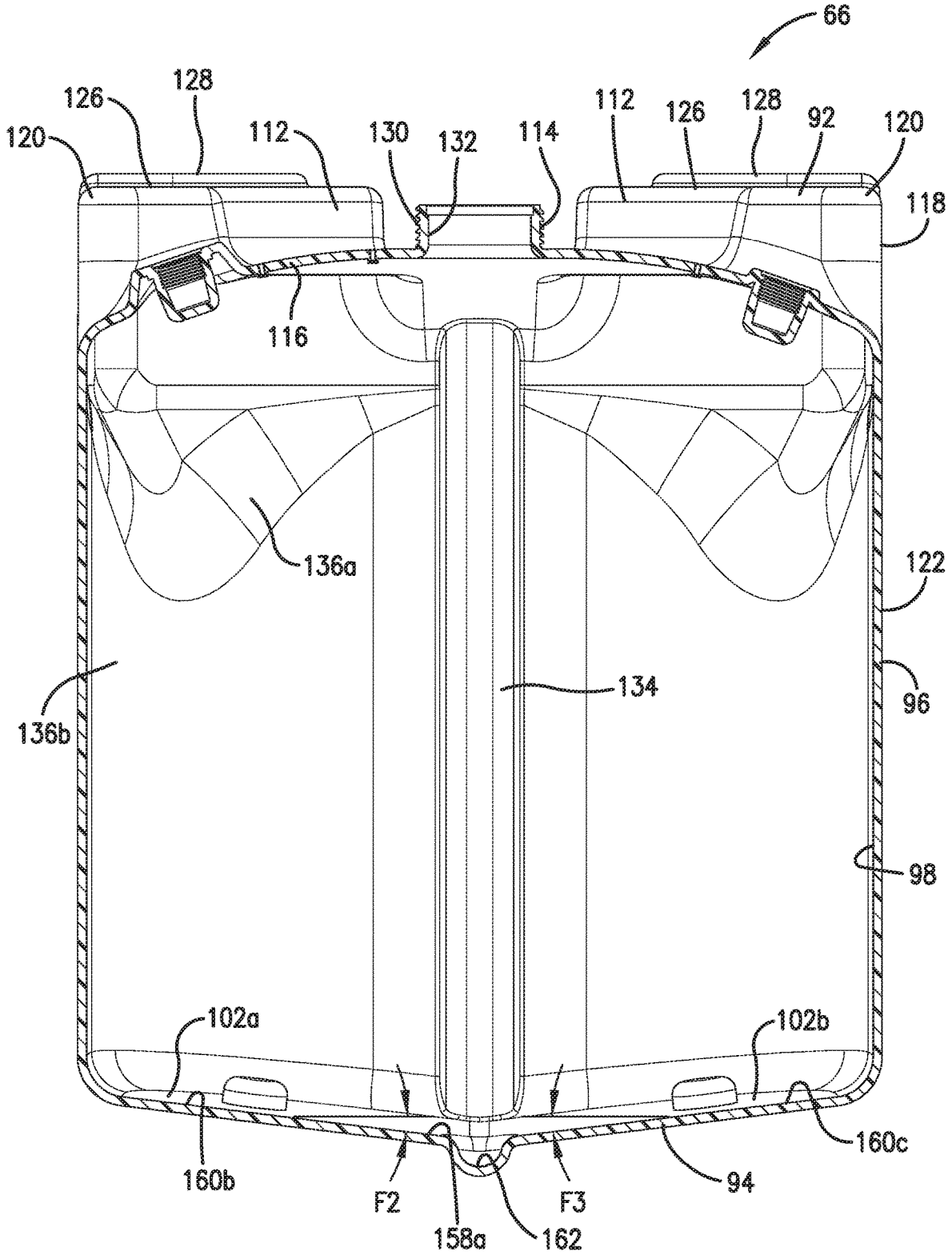
FIG. 15 is a cross section of the receptacle taken along line 15-15 in FIG. 14, showing opposite sloping portions of one floor section.

The illustrated floor section 102 preferably includes opposed floor portions 102*a*,102*b* that slope downwardly toward each other in opposite transverse directions that are generally transverse to the offset direction D1 (see FIGS. 12, 14 and 15). The floor portions 102*a*,102*b* are joined relative to each other along a gutter area 108*b* that extends along the offset direction D1 (see FIG. 12). The gutter area 108*b* slopes downwardly toward the drain opening 110 along the offset direction D1 (see FIG. 14). The gutter area 108*b* presents an elongated gutter axis A2 that extends toward the drain opening 110 (see FIG. 12).

The floor section 102 presents a first interior floor surface 158*a* extending relative to the gutter area 108*a* (see FIG. 14). The first interior floor surface 158 defines a first slope line 160*a* that extends in the offset direction D1 and defines a first floor angle F1 relative to a horizontal plane (see FIG. 14). The first floor angle F1 preferably ranges from about one degree (1°) to about five degrees (5°) and, more preferably, is about three degrees (3°). However, for some aspects of the present invention, the floor section could be alternatively configured so that the first floor angle is outside of the above-referenced range.

The depicted floor portions 102*a*,102*b* define respective parts of the first interior floor surface 158*a*. The first interior floor surface 158*a* defines second and third slope lines 160*b*,160*c* associated with respective floor portions 102*a*, 102*b* and extending perpendicular to the offset direction D1 (see FIG. 15). The second and third slope lines 160*b*,160*c* define second and third floor angles F2,F3 relative to the horizontal plane (see FIG. 15). The second and third floor angles F2,F3 each preferably range from about five degrees (5°) to about ten degrees (10°) and, more preferably, are each about seven degrees (7°). For some aspects of the present invention, the floor section could be alternatively configured so that the second and third floor angles are outside of the above-referenced range.

The illustrated floor section 104 also preferably includes opposed floor portions 104*a*,104*b* that slope downwardly toward each other in opposite transverse directions that are generally transverse to the offset direction D1. (see FIGS. 12 and 14). The depicted floor portions 104*a*,104*b* are separated from each other by the wall section 101 (see FIG. 12).

The floor section 104 presents a second interior floor surface 158*b* extending relative to the gutter area 108*a*. The first interior floor surface 158 defines a fourth slope line 160*d* that extends along the offset direction D1 and defines a fourth floor angle F4 relative to a horizontal plane (see FIG. 14). The floor angle F4 preferably ranges from about five degrees (5°) to about ten degrees (10°) and, more preferably, is about seven degrees (7°). Consistent with the scope of some aspects of the present invention, the floor section could be alternatively configured so that the fourth floor angle is outside of the above-referenced range.

The first interior floor surface 158*b* defines transverse slope lines (not shown) associated with respective floor portions 104*a*,104*b* and extending perpendicular to the offset direction D1. The transverse slope lines of floor portions 104*a*,104*b* preferably define respective floor angles that are substantially the same as floor angles F2,F3. The floor angles defined by the transverse slope lines preferably range from about five degrees (5°) to about ten degrees (10°) and, more preferably, are about seven degrees (7°). For some aspects of the present invention, the floor section could be alternatively configured so that the floor angle defined by the transverse slope lines are outside of the above-referenced range.

The drain opening 110 preferably extends at least partly below the floor sections 102,104. The bottom 94 also preferably includes a trough 162 to collect material from the floor sections 102,104 (see FIGS. 14 and 15). The trough 162 extends below the floor sections 102,104 and fluidly communicates with the drain opening 110. The trough 162 preferably extends along the gutter axis A2 adjacent the gutter area 108*b* and interconnects the floor portions 102*a*, 102*b*.

Figure 3:
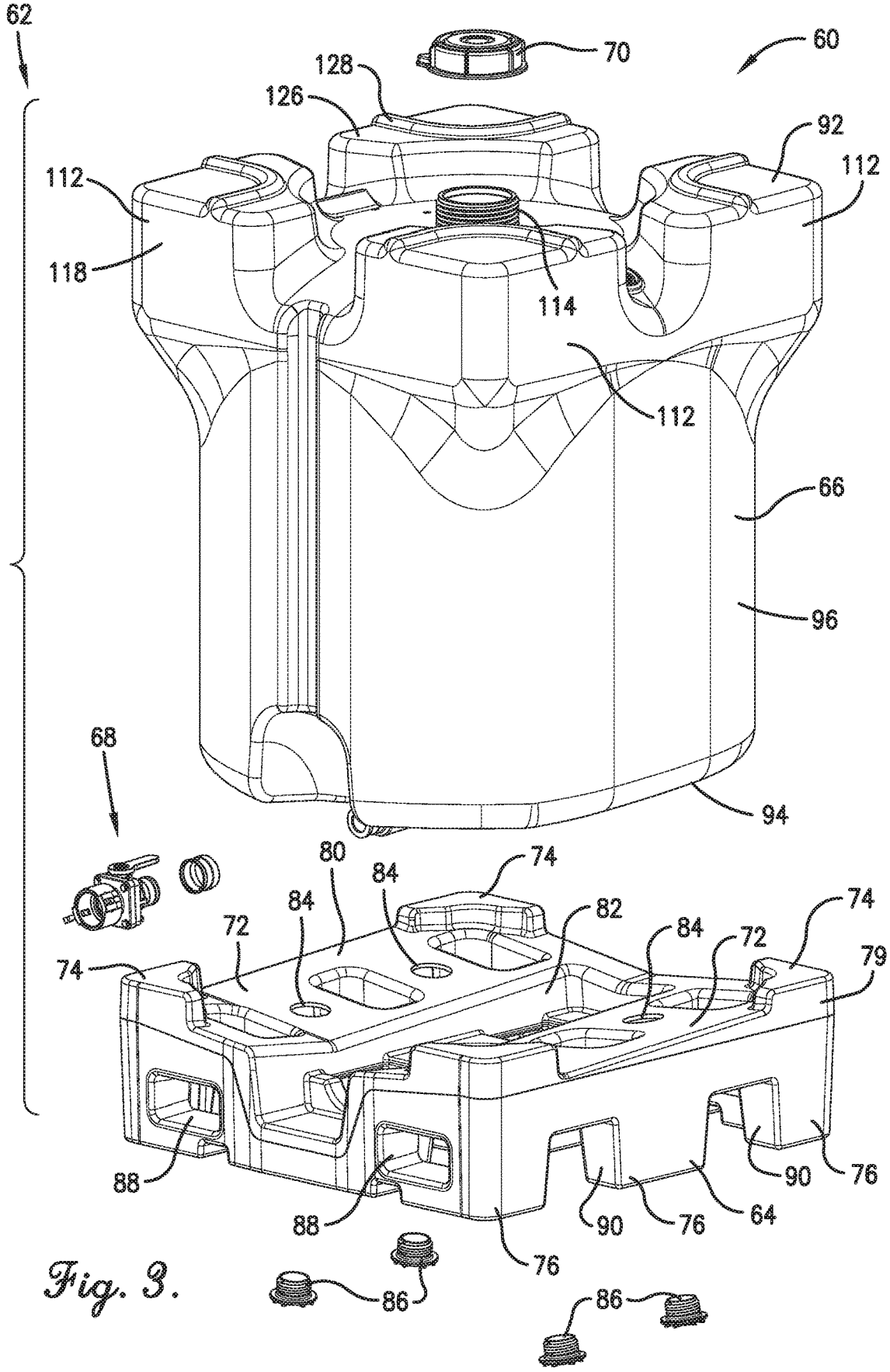
Figure 4:
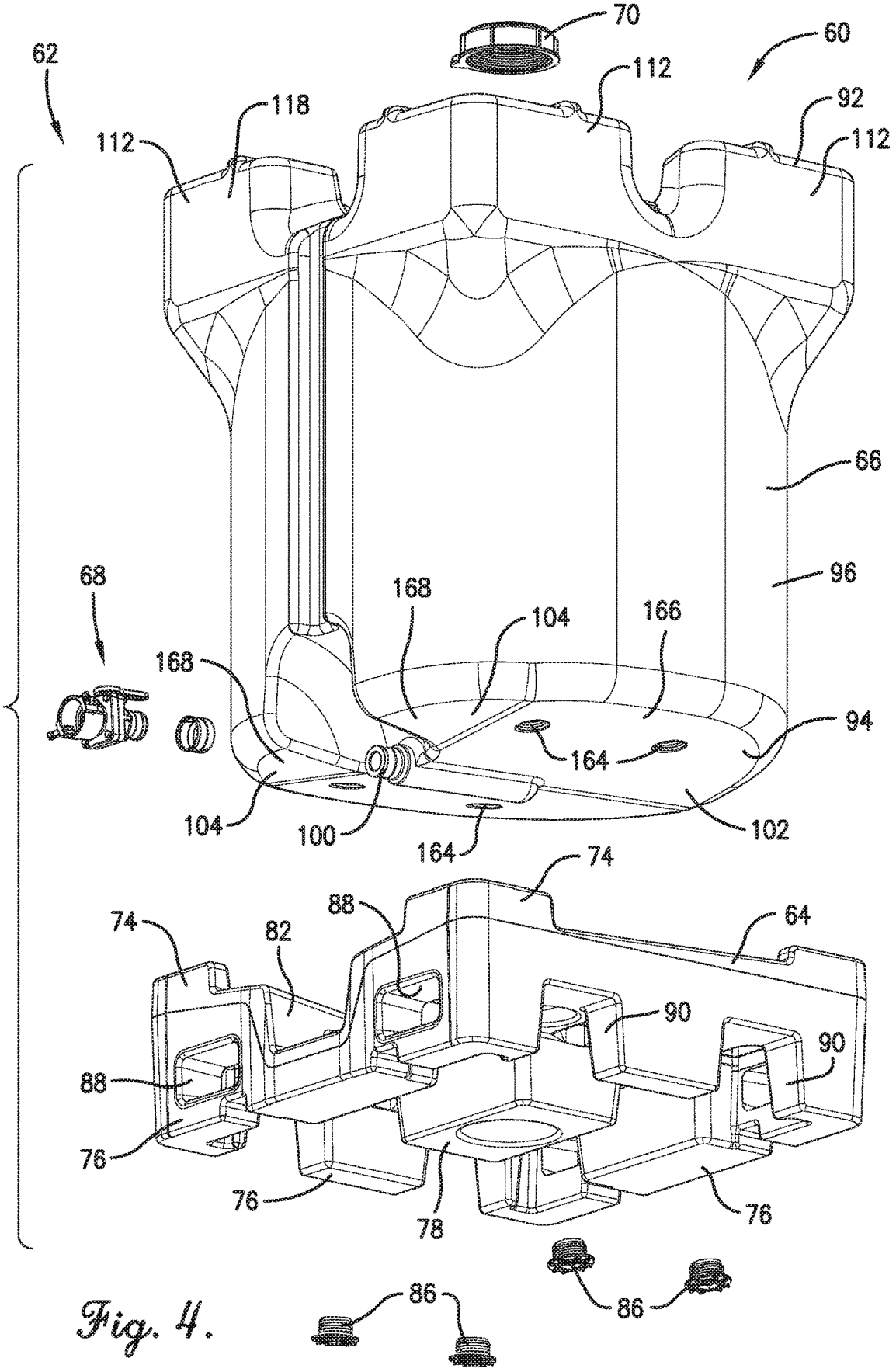
Figure 5:
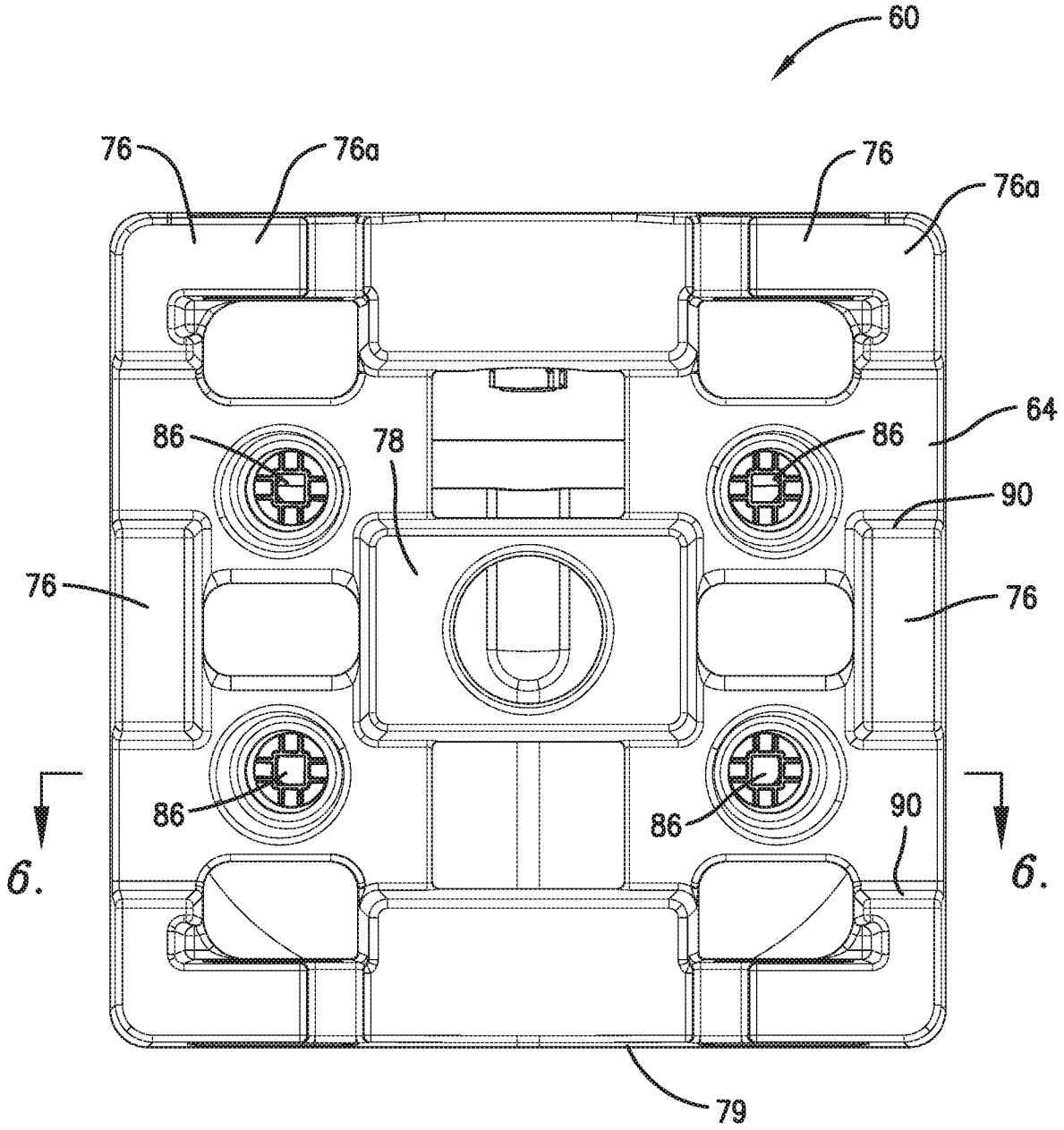
FIG. 5 is a bottom view of the container shown in FIGS. 1-4.
Figure 6:
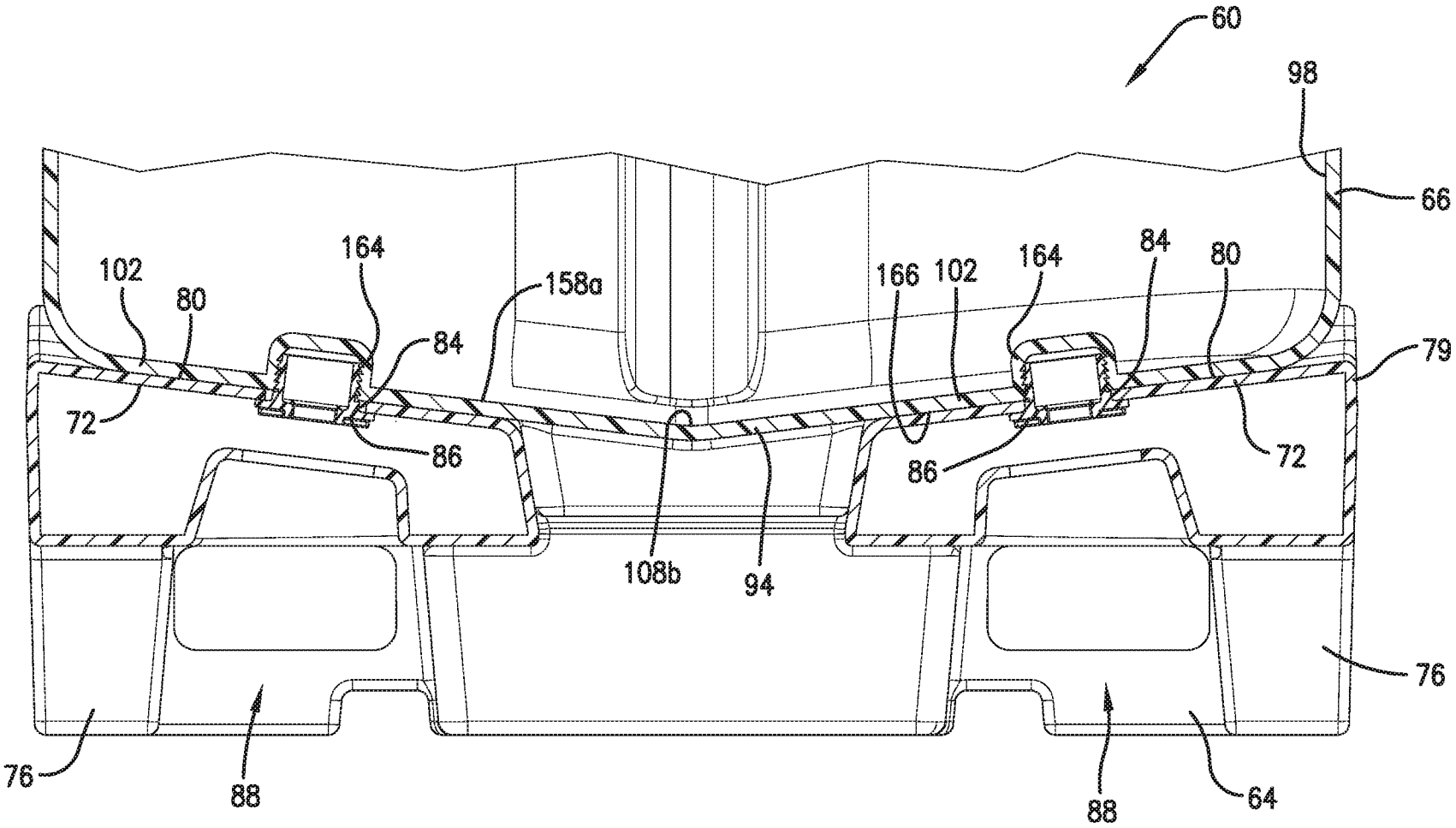
FIG. 6 is a fragmentary cross section of the container taken along line 6-6 in FIG. 5.
Figure 7:
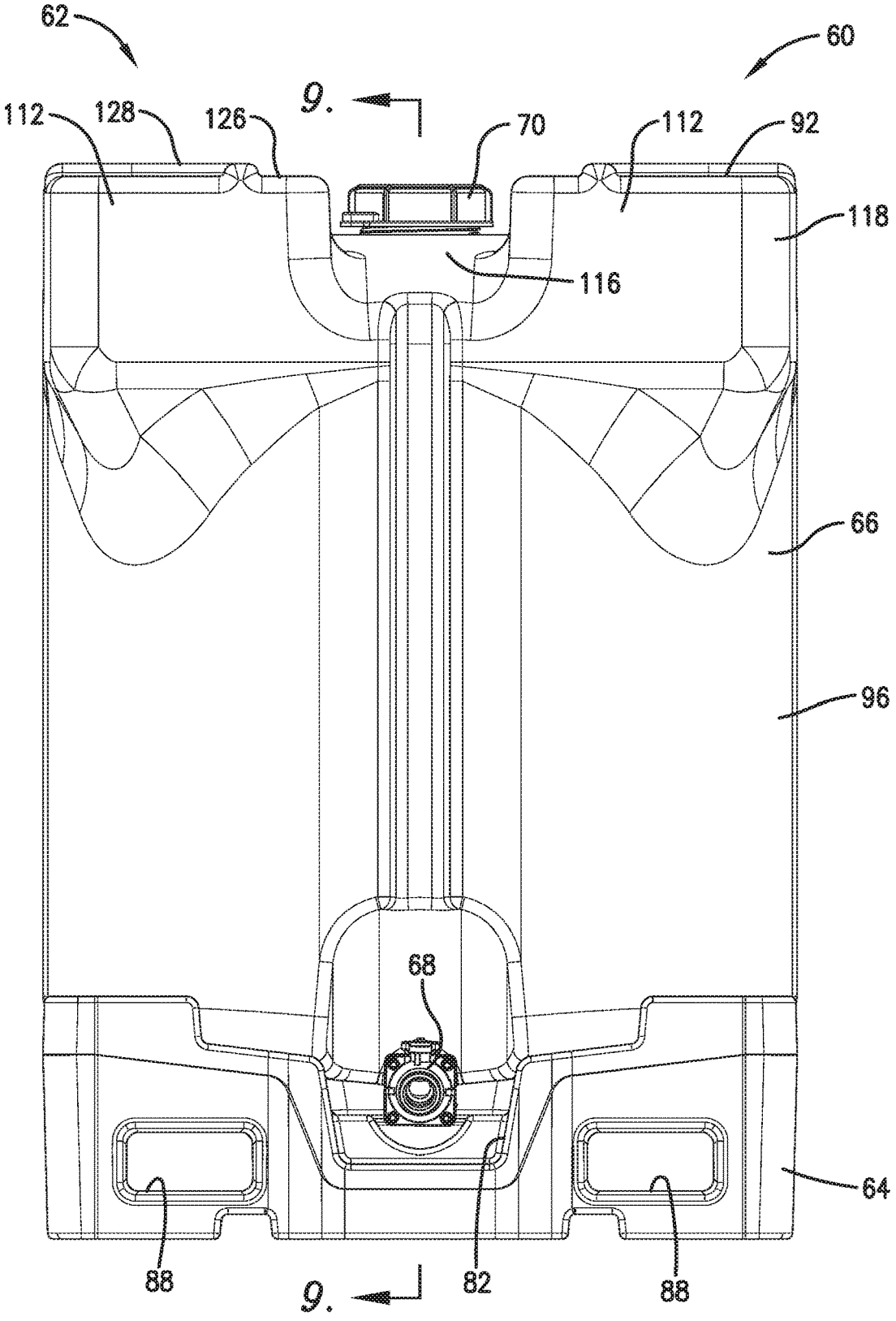
FIG. 7 is a front elevation of the container shown in FIGS. 1-6.
Figure 8:
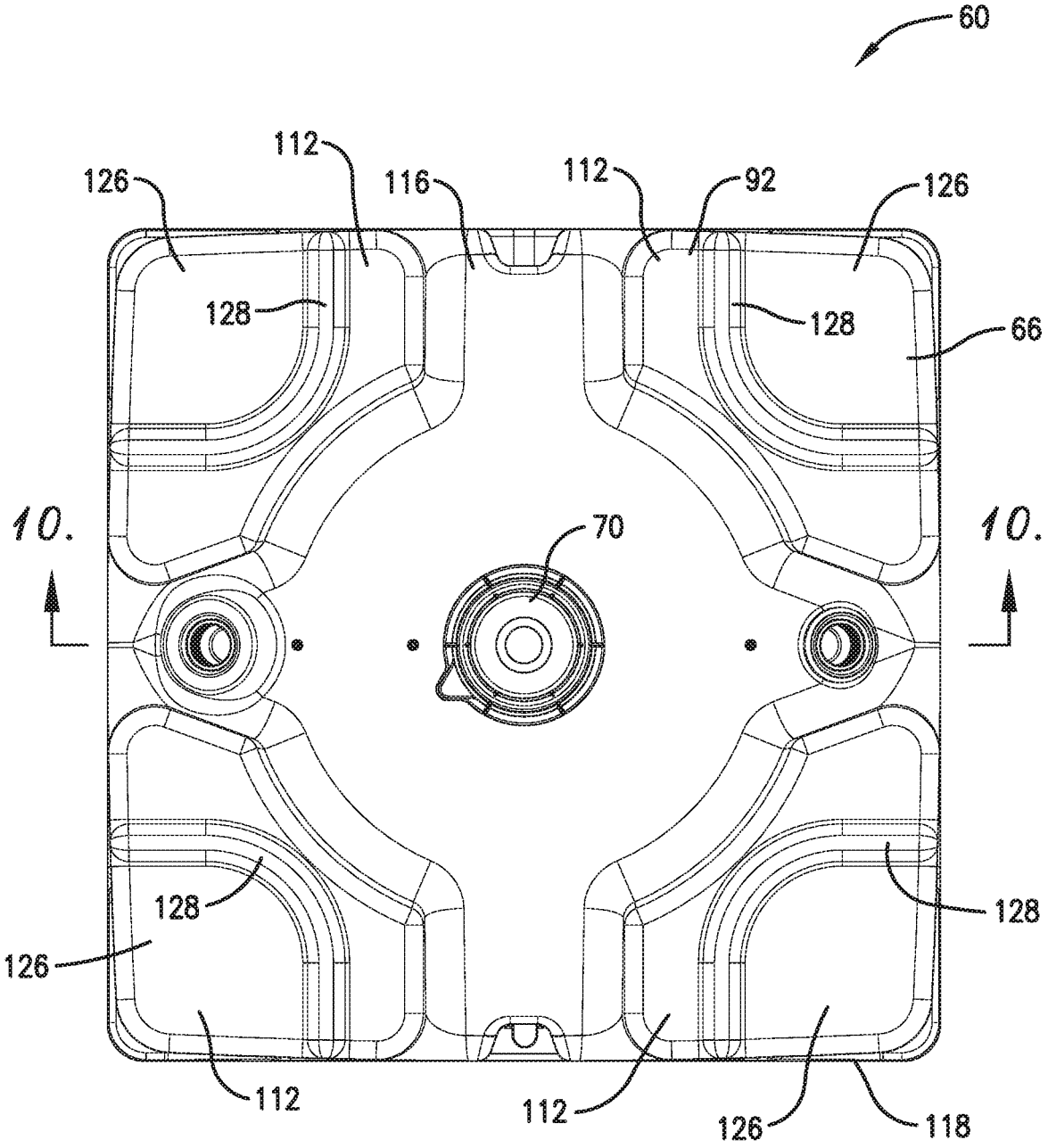
FIG. 8 is a top view of the container shown in FIGS. 1-7.
Figure 9:
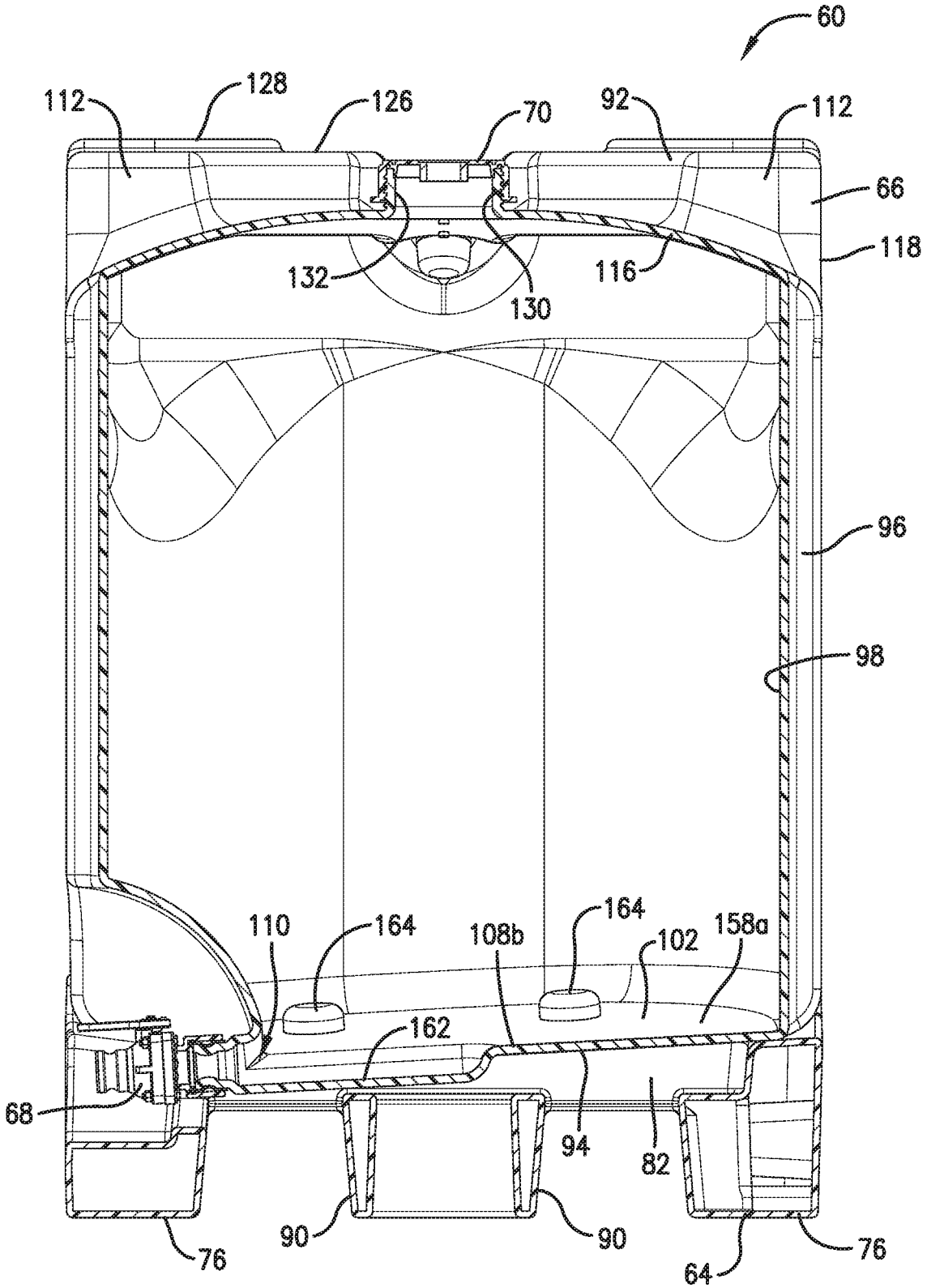
FIG. 9 is a cross section of the container taken along line 9-9 in FIG. 7.
Figure 10:
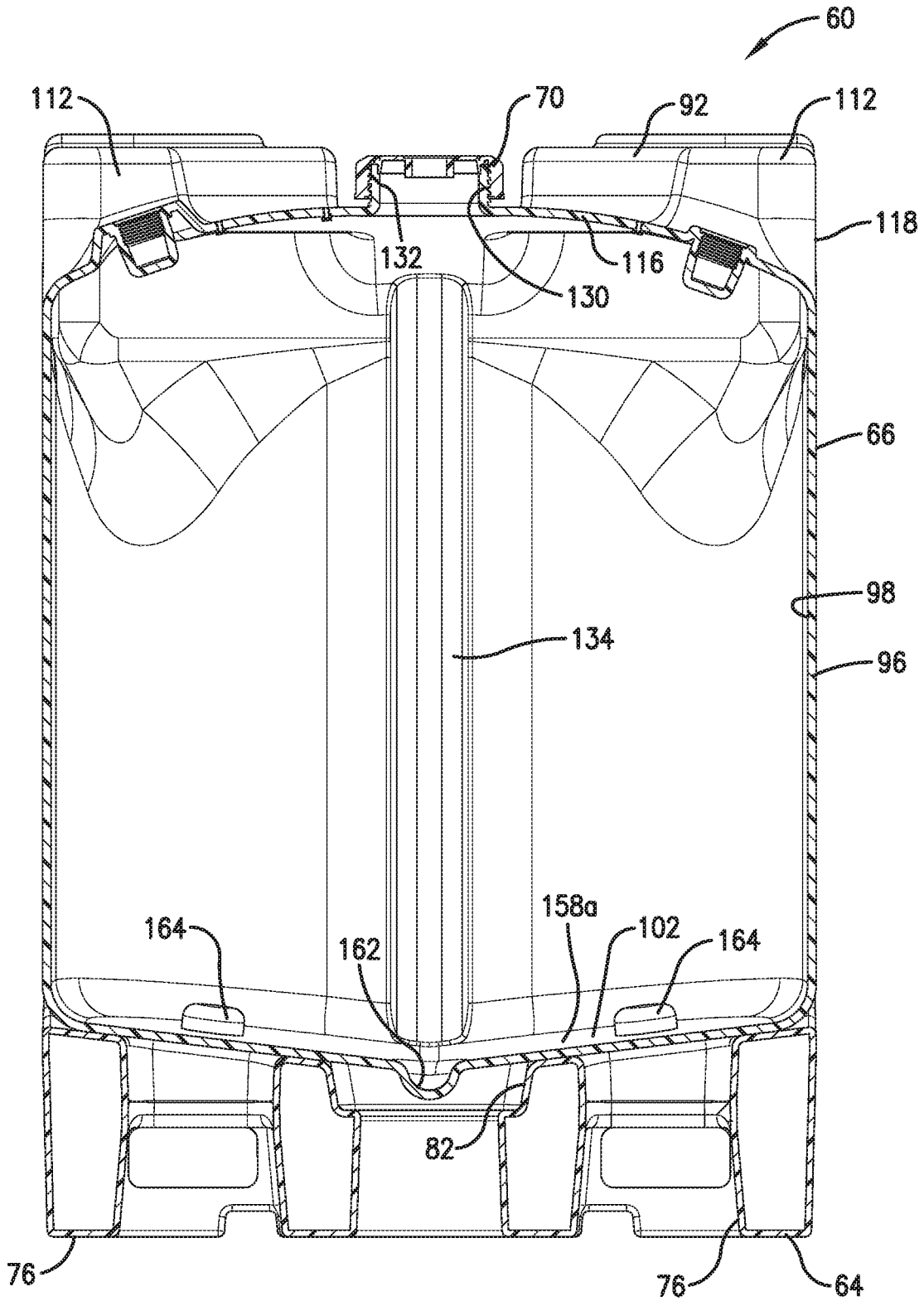
FIG. 10 is a cross section of the container taken along line 10-10 in FIG. 8.

Turning to FIGS. 1-10, the receptacle bottom 94 also preferably includes threaded fasteners 164 and bottom surfaces 166,168 associated with the floor sections 102,104 (see FIGS. 4 and 6). As noted above, the upper panels 72 present respective support surfaces 80 that are removably engaged with corresponding bottom surfaces 166,168. Preferably, the support surfaces 80 are configured to engage the bottom surfaces 166,168 when the receptacle 66 is supported on the pallet 64. More preferably, the support surfaces 80 generally conform to the bottom surfaces 166,168 (see FIG. 6).

When the receptacle 66 is positioned on the pallet 64, the pallet 64 and receptacle 66 are operable to be removably secured by fasteners 86 and 164 (see FIGS. 3, 4 and 6). In the depicted embodiment, the threaded fasteners 164 are integrally formed as part of the floor section 102. The fasteners 164 have threaded openings that are configured to be threadably engaged by fasteners 86. To secure the pallet 64 and receptacle 66, the fasteners 86 are positioned to extend through the fastener openings 84 and be threaded into engagement with the fasteners 164.

Although the illustrated fastener arrangement is preferred for removably securing the pallet 64 and receptacle 66, alternative embodiments of the container may use an alternative fastener configuration. For instance, the pallet and receptacle could be attached with an alternative number of fasteners. Also, the fastening connection between the pallet and receptacle may employ other types of fastening mechanisms (e.g., alternative threaded fasteners). With respect to some aspects of the present invention, the container may be devoid of fasteners for attaching the receptacle to a pallet (e.g., for alternative container embodiments that are devoid of a pallet).

Turning to FIGS. 18 and 19, the receptacle top 92 is operable to facilitate stacking of multiple containers. As explained above, the top corner sections 120 of the pillars 112 preferably engage pallet corner sections 76*a* to support the pallet 64 on the receptacle top 92. The pallet 64 preferably has a pallet peripheral margin 79 that is generally shaped to conform to the top peripheral margin 118 of the receptacle 66. The shapes of the peripheral margins 79,118 permit the pallet 64 and receptacle top 92 to be efficiently aligned and engaged when the pallet 64 is positioned on the top 92. Consequently, multiple containers 60 of the stackable container system 62 can be stacked on top of one another while receiving bulk material therein.

Alternative Embodiments

Turning to FIGS. 32-50, alternative preferred embodiments of the present invention are depicted. For the sake of brevity, the remaining description will focus primarily on the differences of these alternative embodiments from the preferred embodiment described above.

Initially turning to FIGS. 32-36, an alternative container 200 is constructed in accordance with a second embodiment of the present invention. The depicted container 200 preferably includes a pallet 202, an alternative receptacle 204, valve assembly 206, and an alternative lid 208.

Figure 32:
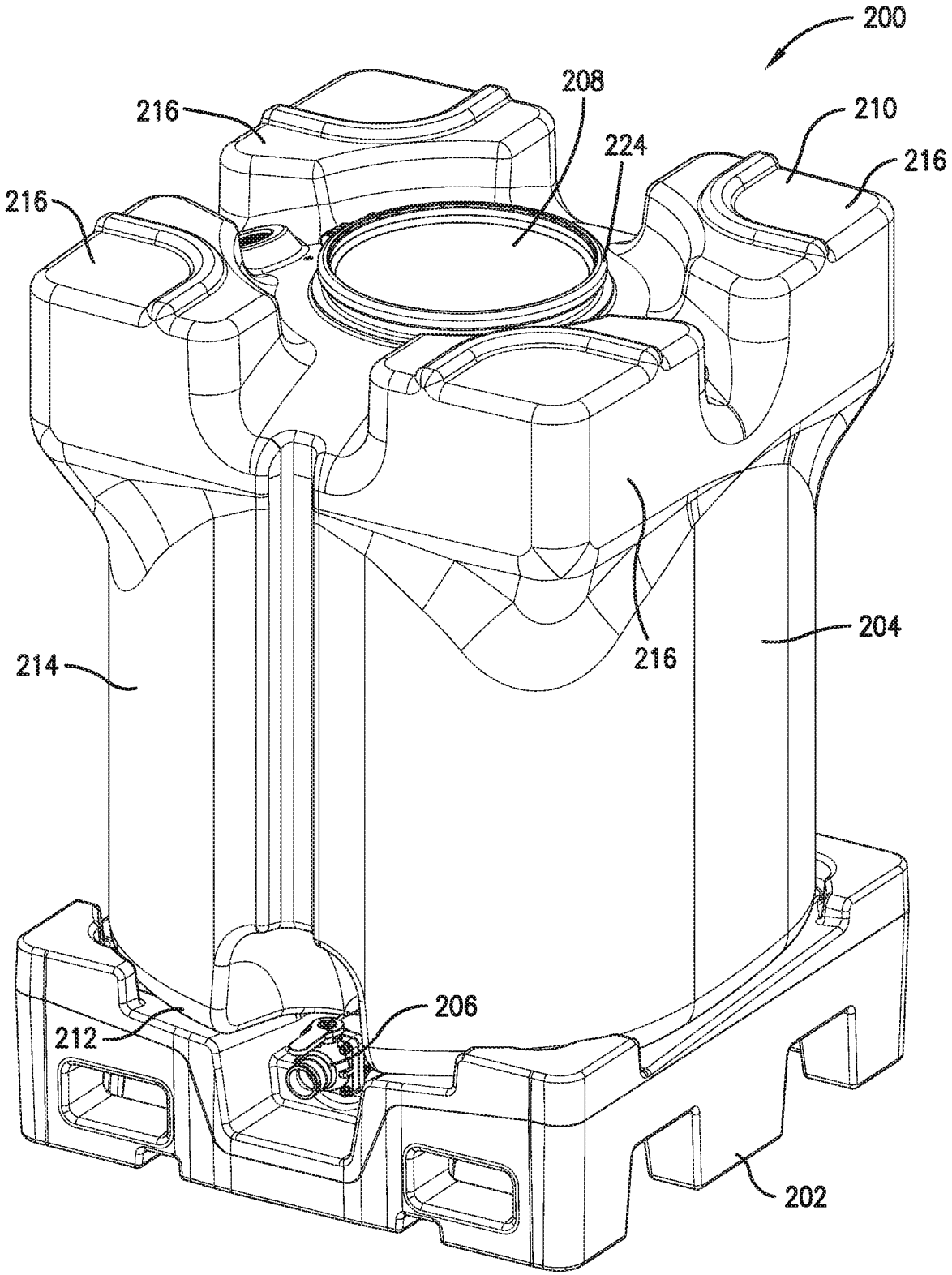
FIGS. 32-36 are views of a container constructed in accordance with a second preferred embodiment of the present invention.

In the illustrated embodiment, the receptacle 204 preferably includes an alternative receptacle top 210, a receptacle bottom 212, and a receptacle side 214 (see FIG. 32). The receptacle top 210 is configured to at least partly support another receptacle 204 stacked relative thereto. The receptacle top 210 preferably includes alternative pillars 216 and an alternative fill neck 218.

Figure 33:
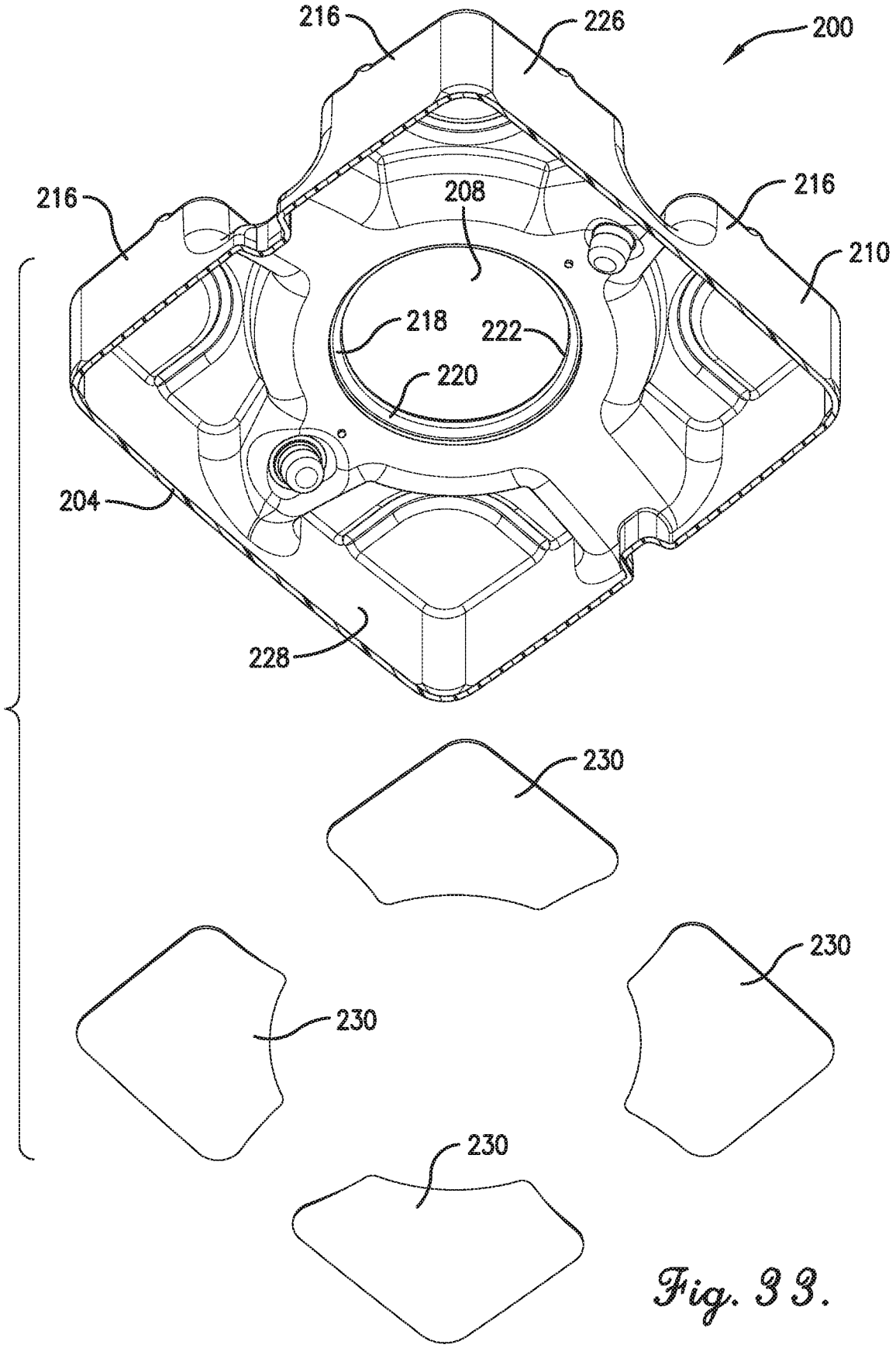
Figure 34:
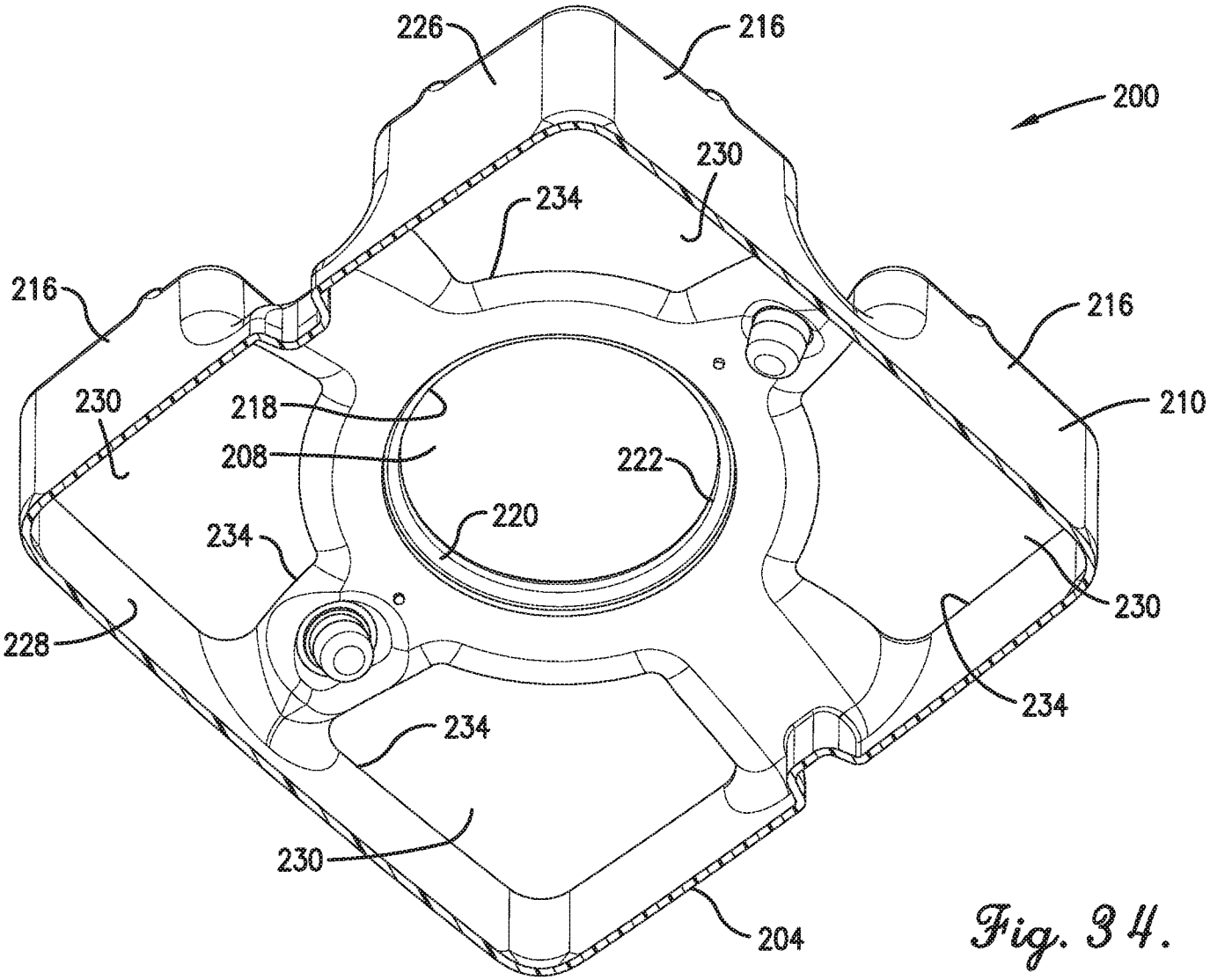
Figure 35:
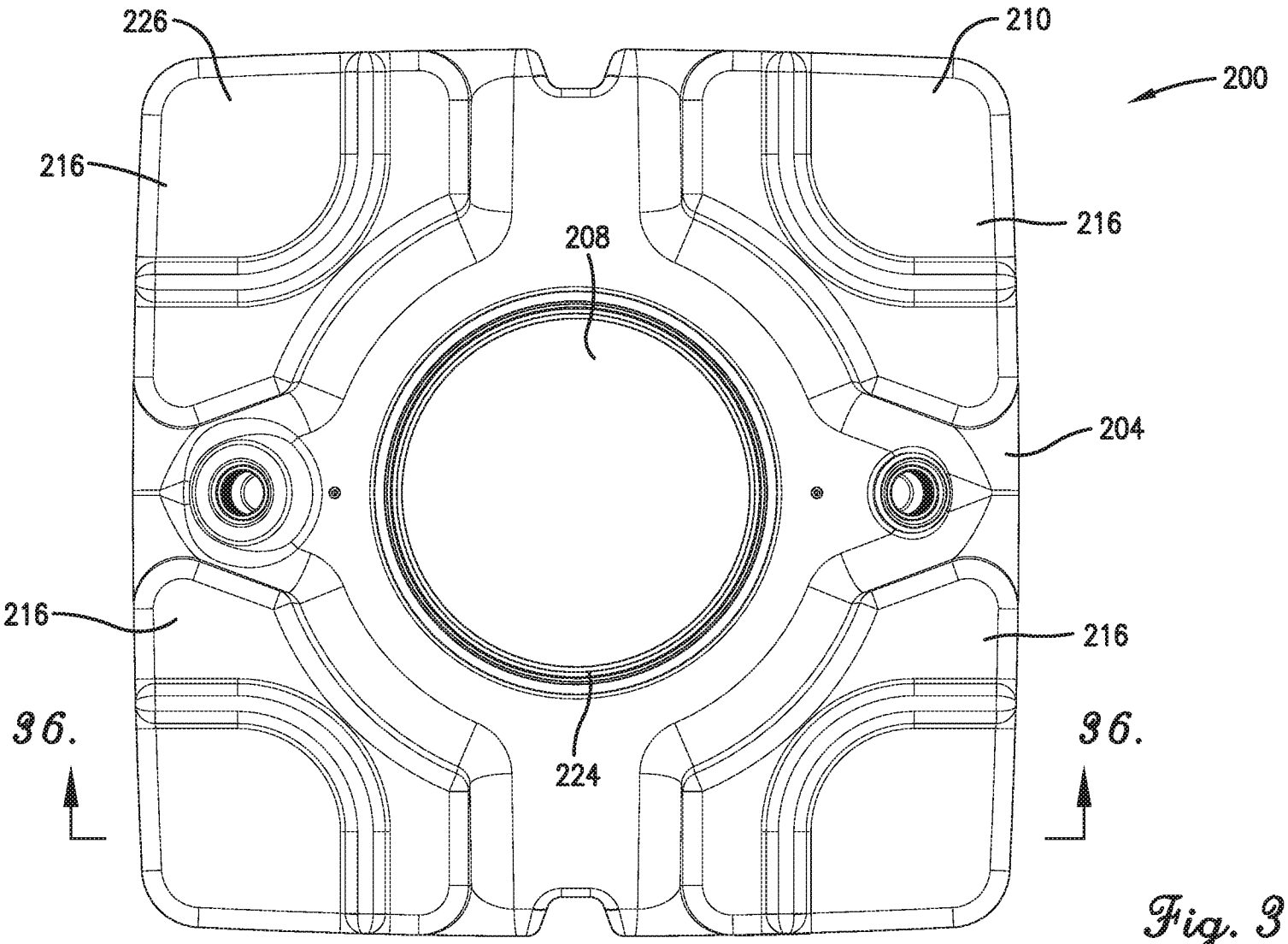

The fill neck 218 is configured to receive the lid 208 and includes a tube 220 that presents a fill opening 222 (see FIGS. 33 and 34). The depicted lid 208 preferably comprises a conventional, large-mouth lid for an intermediate bulk container. The lid 208 is operable to be removably secured to the fill neck 218 with an adjustable band 224 to close the fill opening 222.

In the illustrated embodiment, the pillars 216 each include a hollow wall structure 226 that defines a respective part of a container chamber 228. Each pillar 216 also preferably includes a shutoff wall 230. The shutoff wall 230 is located within a respective pillar to define a subchamber 232.

The receptacle 204, including the shutoff walls 230, preferably comprises a synthetic resin material. Similar to the prior embodiment, the synthetic resin material preferably comprises a polymer material, such as a high-density polyethylene (HDPE) material. However, it is also within the ambit of the present invention for alternative receptacle embodiments to include an alternative polymer.

Figure 36:
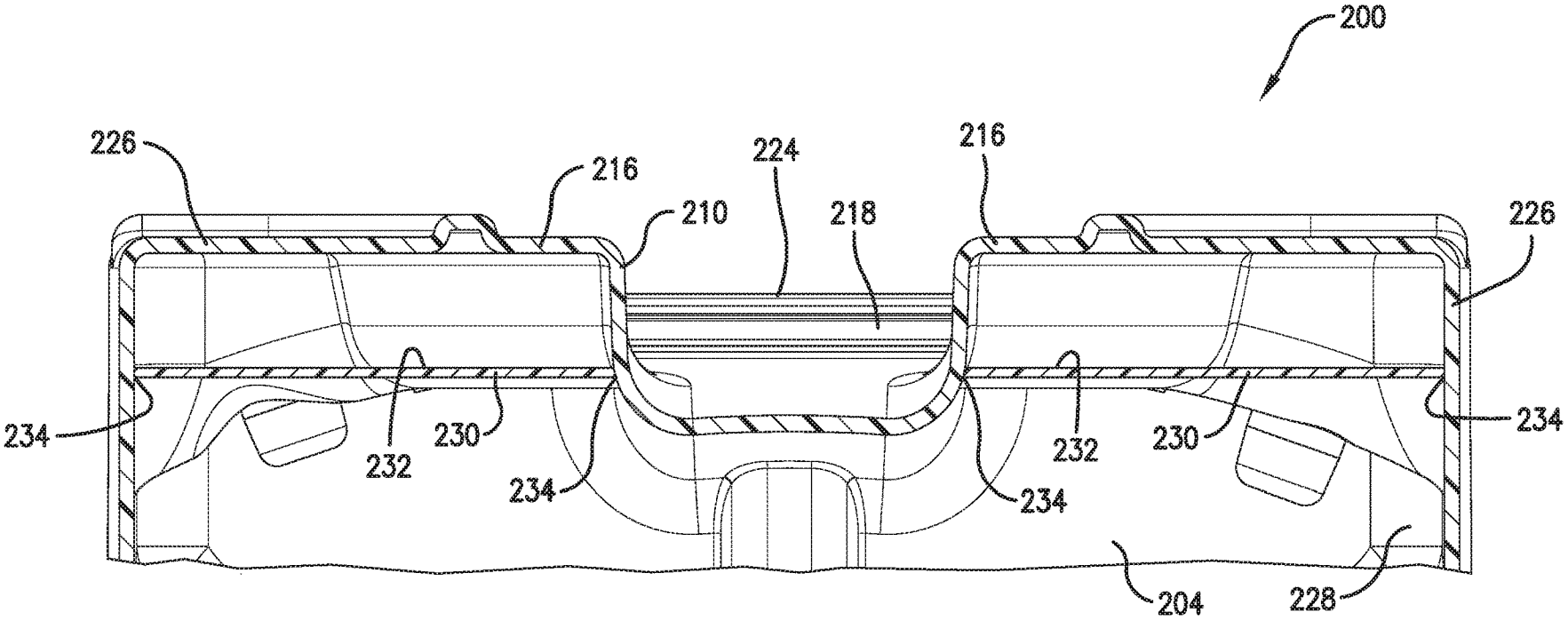

Each of the depicted shutoff walls 230 is preferably fixed inside a respective one of the pillars 216 and seals off the subchamber 232 from the remainder of the container chamber 228 (see FIG. 36). Most preferably, the shutoff walls 230 are welded to the wall structure along the entire margin to form an endless weld 234 (see FIGS. 34 and 36). The walls 230 are preferably welded to the wall structure 226 using conventional polymer welding techniques. It is also within the scope of some aspects of the present invention for the shutoff walls to be alternatively fixed to the wall structure. For instance, the shutoff walls could be integrally molded with the pillars or adhered thereto.

Turning to FIGS. 37-43, an alternative container 300 is constructed in accordance with a third embodiment of the present invention. The depicted container 300 preferably includes a pallet 302, an alternative receptacle 304, valve assembly 306, and an alternative removable lid 308. The container 300 also preferably presents a container chamber 309. As will be explained, the receptacle 304 and lid 308 are particularly configured to receive bulk material and to experience a pressure differential for which an internal container pressure is greater than ambient pressure.

Figure 37:
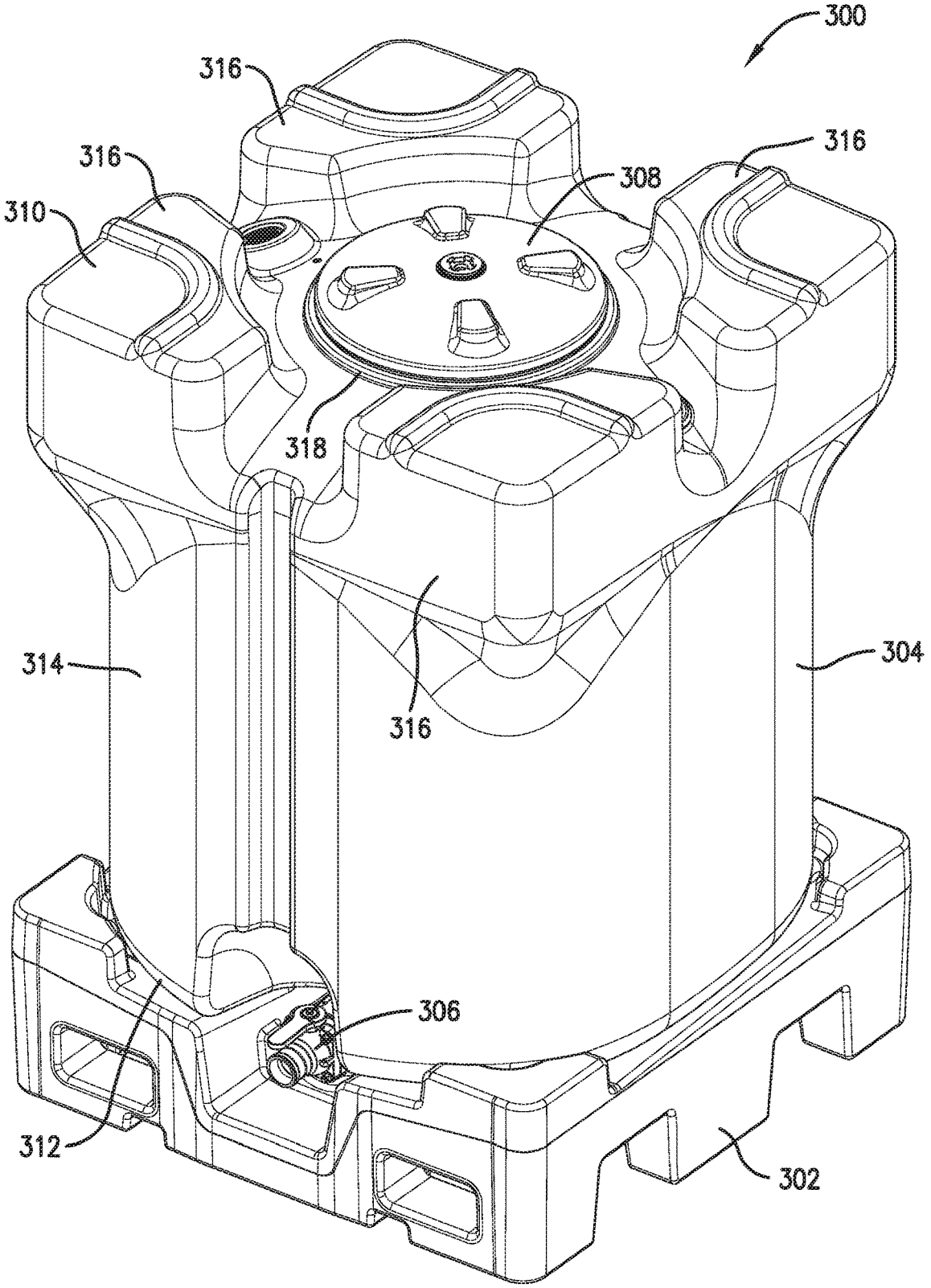
FIGS. 37-43 are views of a container constructed in accordance with a third preferred embodiment of the present invention.
Figure 38:
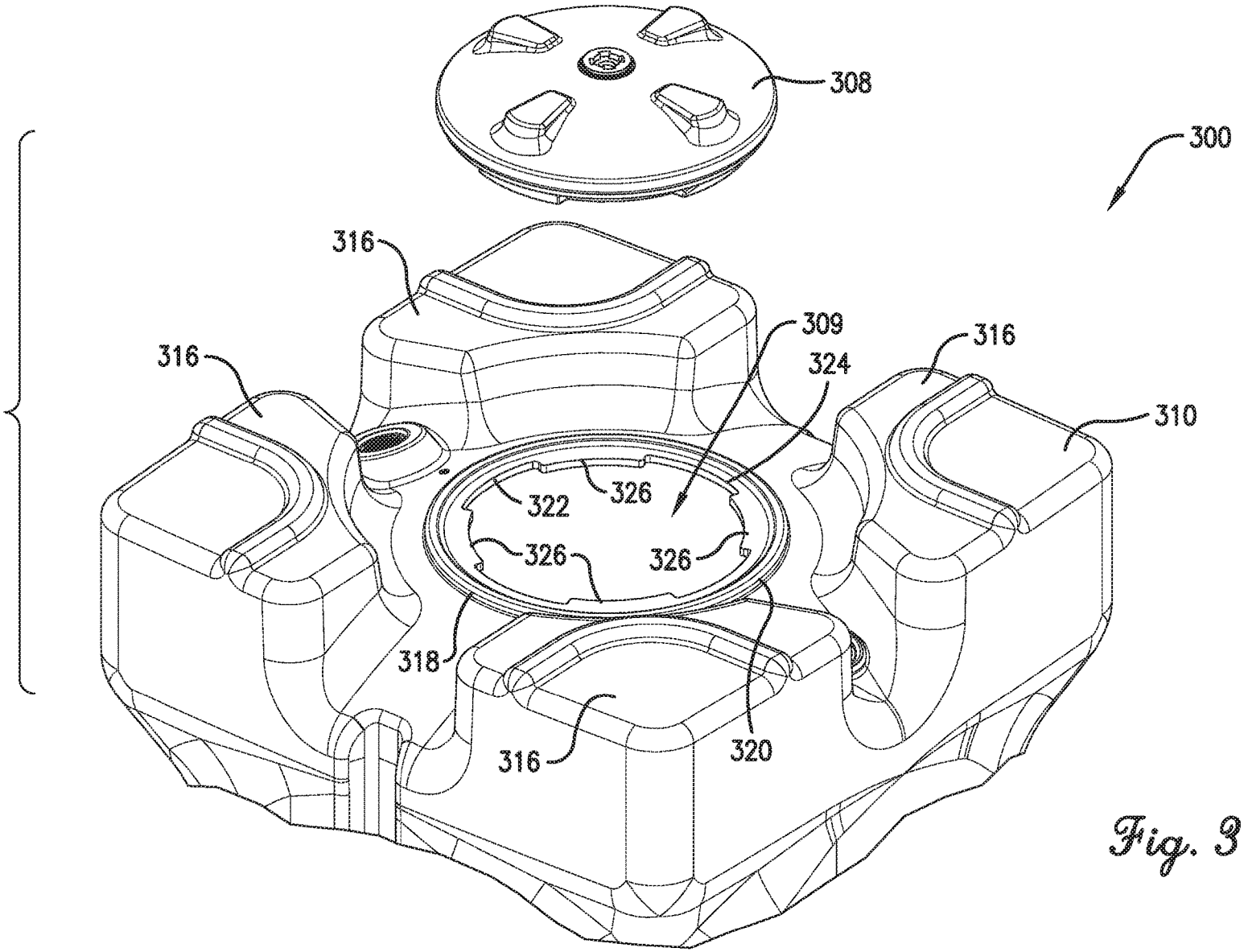
Figure 39:
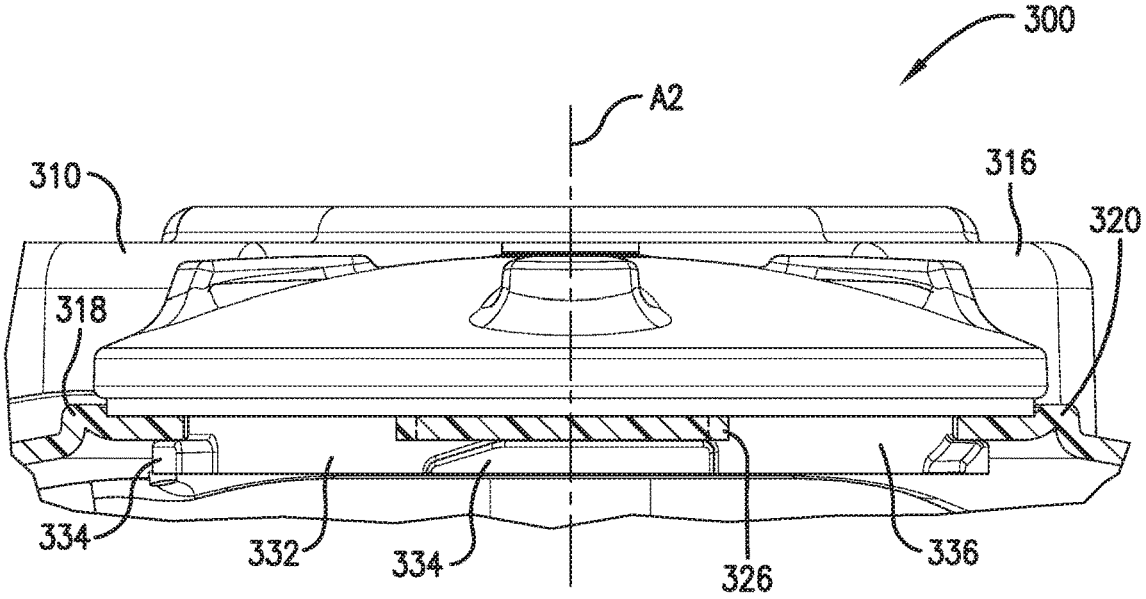
Figure 40:
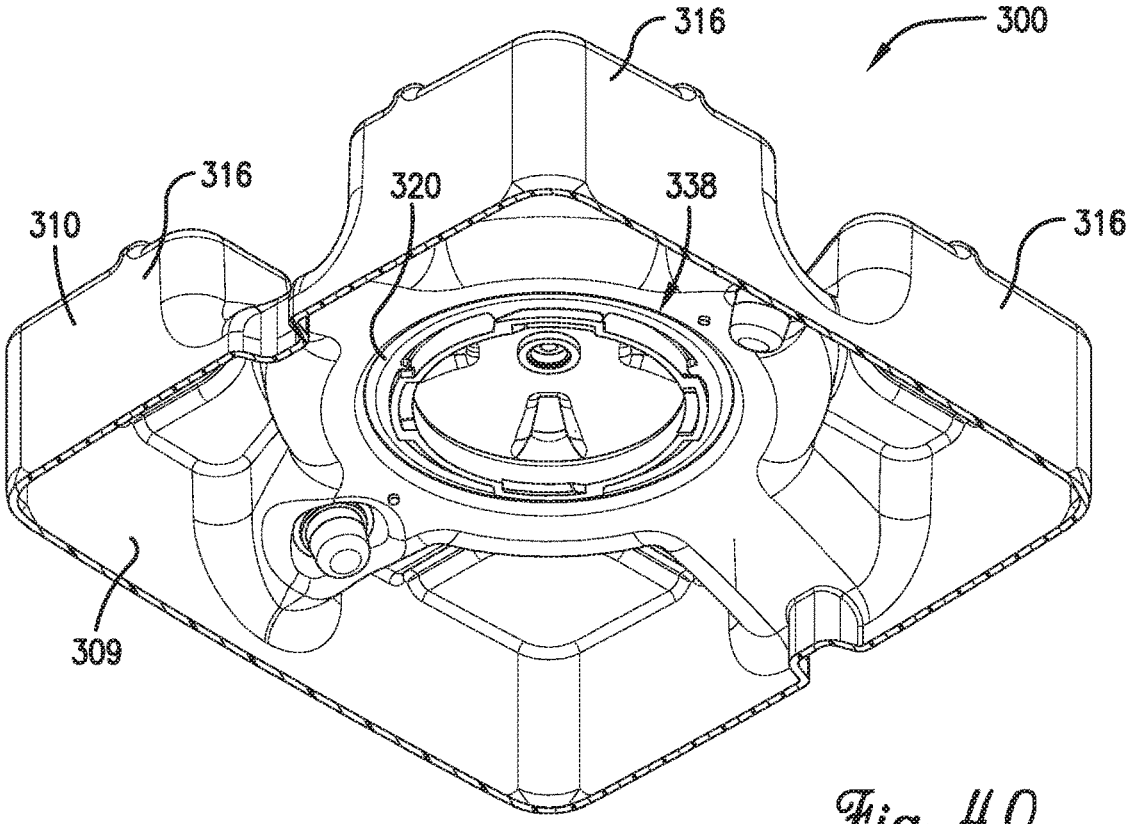
Figure 41:
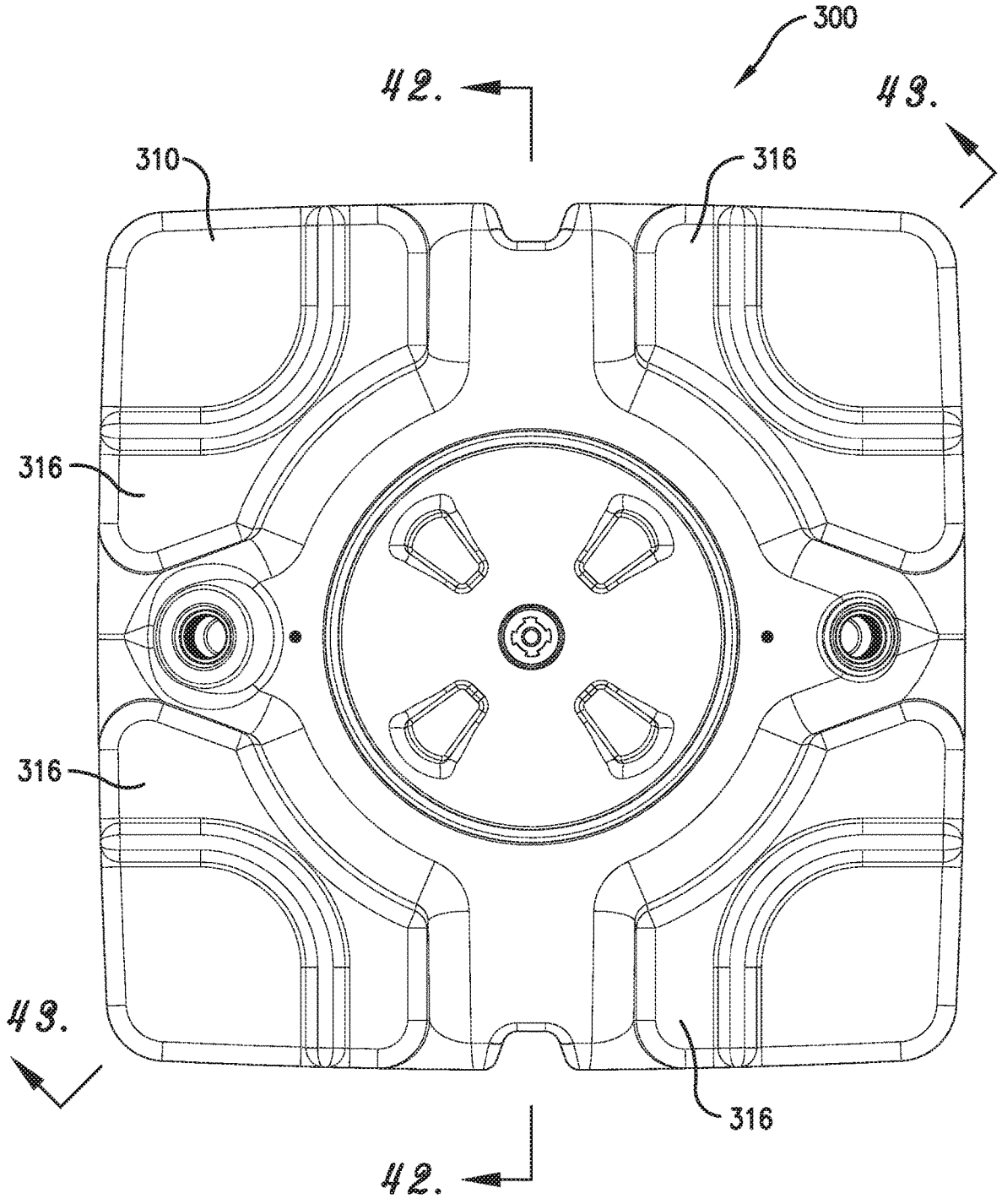
Figure 42:
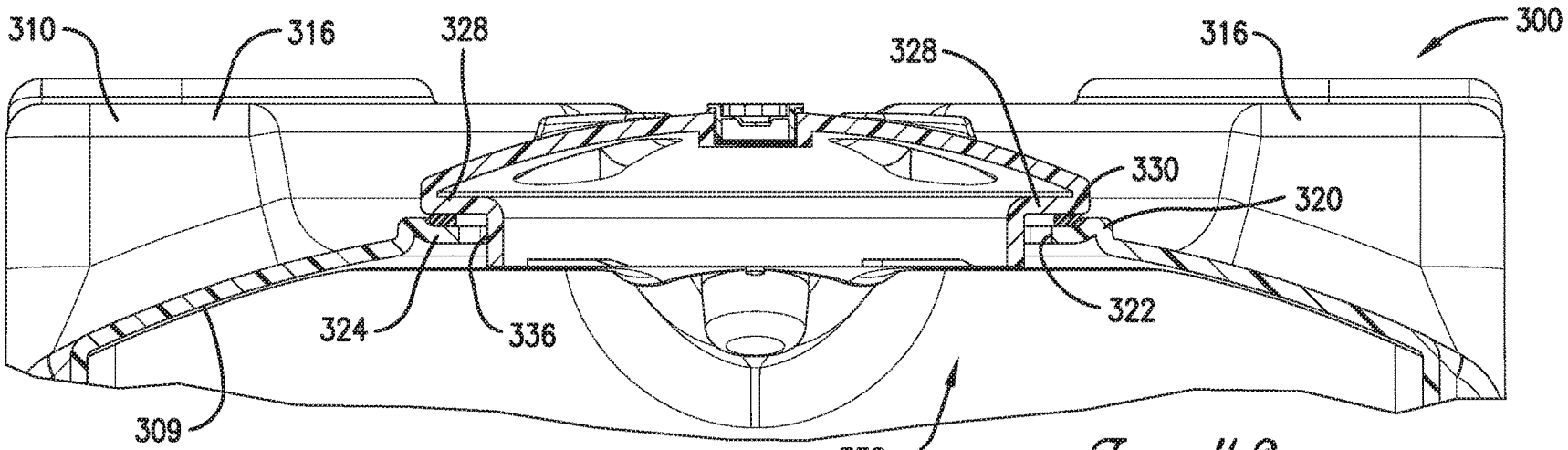
Figure 43:
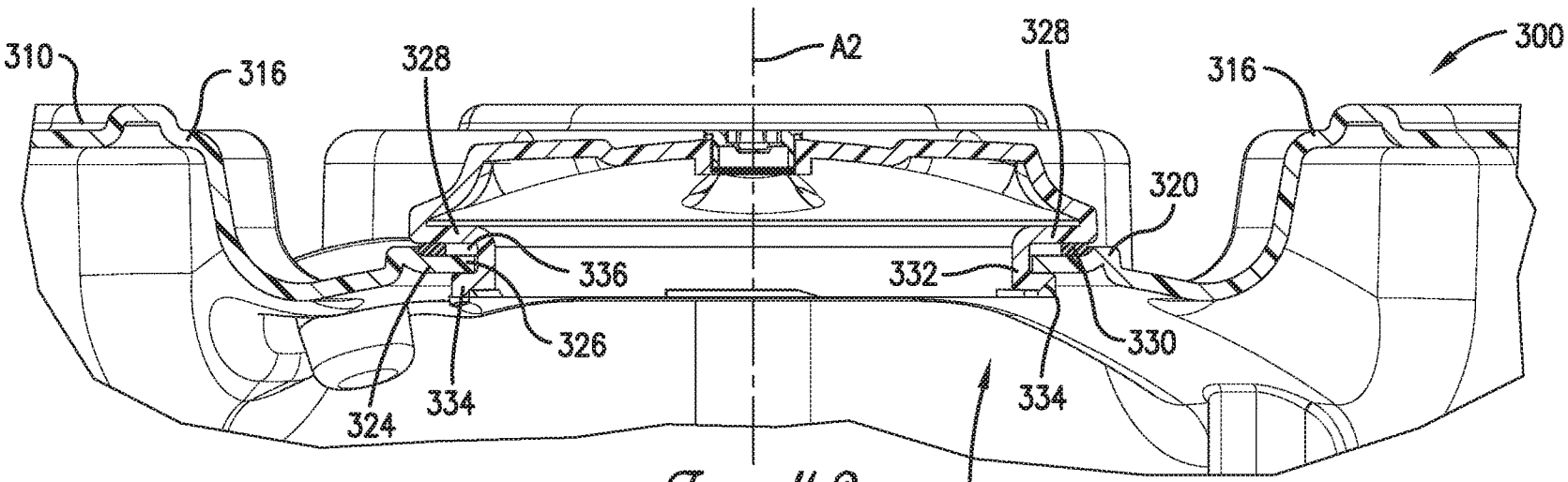

In the illustrated embodiment, the receptacle 304 preferably includes an alternative receptacle top 310, a receptacle bottom 312, and a receptacle side 314 (see FIG. 37). The receptacle top 310 is configured to at least partly support another receptacle 304 stacked relative thereto. The receptacle top 310 preferably includes pillars 316 and an alternative fill neck 318.

The fill neck 318 is configured to removably receive the lid 308. The fill neck 318 includes a receptacle connector 320 to engage the lid 308 and presents a fill opening 322 (see FIG. 38). The till opening 322 fluidly communicates with the chamber 309.

The receptacle connector 320 preferably includes a flange plate 324 that extends continuously about the fill opening 322 and spaced apart connector teeth 326. The connector teeth 326 are spaced about the fill opening 322 and project radially inwardly from the flange plate 324.

The lid 308 is operable to cover the fill opening 322 in an engaged condition to enclose the chamber 309. The illustrated lid 308 includes a lid flange 328, a seal 330, and a lid connector 332 with spaced apart connector lugs 334 (see FIGS. 39, 42 and 43). The lid 308 also presents a circumferential groove 336 that extends along the connector lugs 334 (see FIGS. 39, 42 and 43).

The seal 330 extends circumferentially along the lid flange 328 and sealingly engages the flange plate 324 when the connector teeth 326 and lugs 334 engage one another to restrict fluid flow through the fill opening 322. The circumferential groove 336 receives the connector teeth 326 when the teeth 326 and lugs 334 engage one another.

When the lid 308 is in the engaged condition, the receptacle connector 320 and the lid connector 332 cooperatively provide a fractional-turn connection 338. The connection 338 is operable so that the connector teeth 326 and lugs 334 are rotatable into and out of engagement with one another. When the lid is engaged, the connection 338 preferably restricts lid separation from the fill neck 318 (e.g., when the lid 308 is urged out of engagement with the fill neck due to a pressure differential caused by pressure within the chamber 309).

The lid 308 is rotatable about a connection axis A2. (see FIGS. 39 and 43) between the engaged condition and a disengaged condition in which the connector teeth 326 and lugs 334 are disengaged from each other to permit removal of the lid 308 to uncover the fill opening 322. As the lid 308 rotates, the lid connector 332 is preferably rotatable relative to the receptacle connector 320 about the connection axis A2.

Preferably, the connection 338 is configured so that the lid 308 is rotatable relative to the fill neck 318 about one-quarter turn from the engaged condition to the disengaged condition. However, the fractional-turn connection may be alternatively configured within the scope of some aspects of the present invention. For instance, alternative embodiments of the connection may require less than one-quarter turn or greater than one-quarter turn between the engaged and disengaged conditions.

Turning to FIGS. 44-50, an alternative container 400 is constructed in accordance with a fourth embodiment of the present invention. The depicted container 400 preferably includes a pallet (not shown), an alternative receptacle 404, valve assembly (not shown), and an alternative removable lid 408. The container 400 also preferably presents a container chamber 409. As will be explained, the receptacle 404 and lid 408 are particularly configured to receive bulk material and to experience a pressure differential for which an internal container pressure is greater than ambient pressure.

Figure 44:
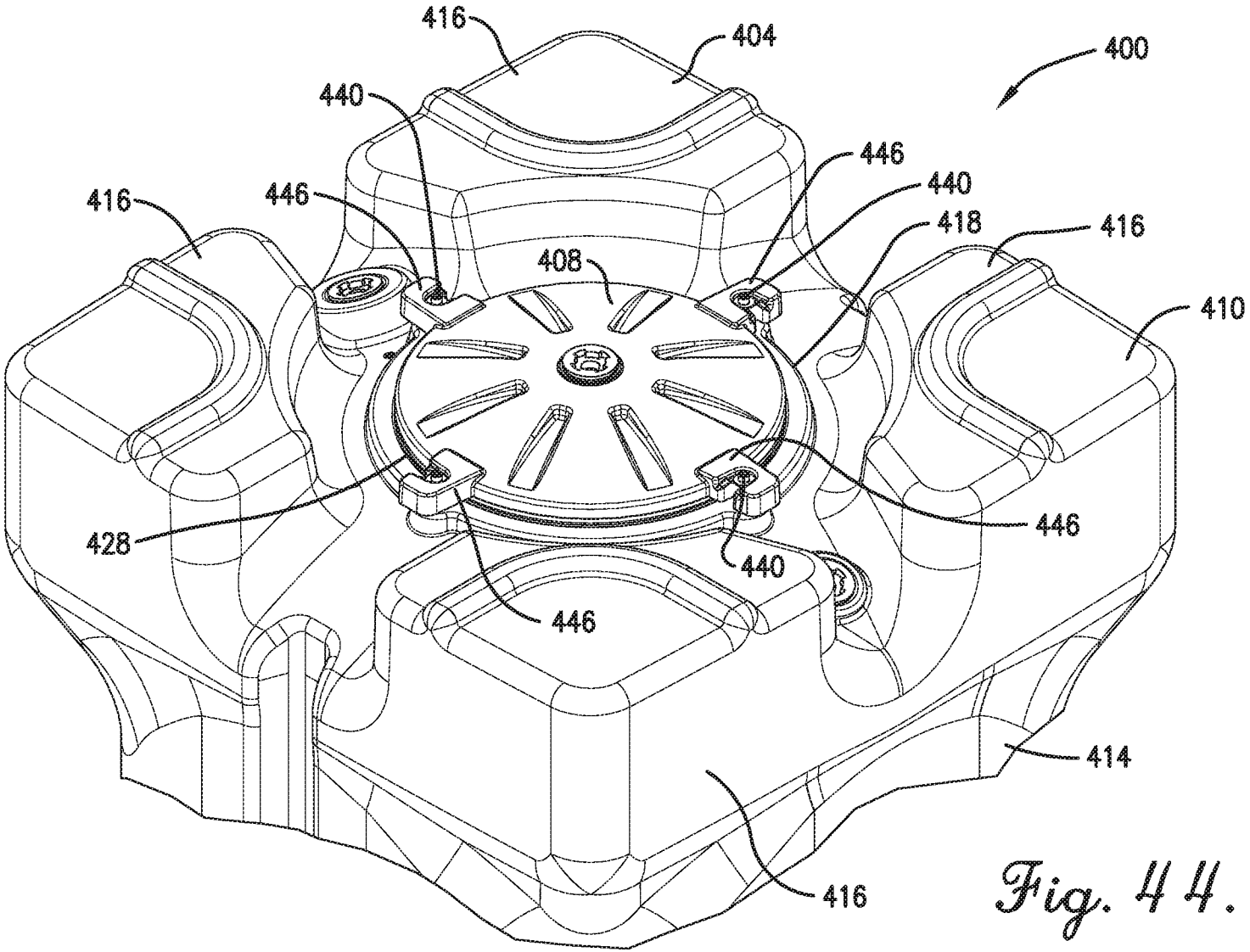
FIGS. 44-50 are views of a container constructed in accordance with a fourth preferred embodiment of the present invention.

In the illustrated embodiment, the receptacle 404 preferably includes an alternative receptacle top 410, a receptacle bottom (not shown), and a receptacle side 414 (see FIG. 44). The receptacle top 410 preferably includes pillars 416 and an alternative fill neck 418.

The fill neck 418 is configured to removably receive the lid 408. The fill neck 418 includes a receptacle connector 420 to engage the lid 408 and presents a fill opening 422 (see FIG. 45). The fill opening 422 fluidly communicates with the chamber 409.

The receptacle connector 420 preferably includes a flange plate 424 that extends continuously about the fill opening 422 and spaced apart connector teeth 426. The connector teeth 426 are spaced about the fill opening 422 and project radially inwardly from the flange plate 424.

The lid 408 is operable to cover the fill opening 422 in an engaged condition to enclose the chamber 409. The illustrated lid 408 includes a lid flange 428, a seal 430, and a lid connector 432 with spaced apart connector lugs 434 (see FIGS. 48 and 49). The lid 408 also presents a circumferential groove 436 that extends along the connector lugs 434 (see FIG. 49).

The seal 430 extends circumferentially along the lid flange 428 and sealingly engages the flange plate 424 when the connector teeth 426 and lugs 434 engage one another to restrict fluid flow through the fill opening 422. The circumferential groove 436 receives the connector teeth 426 when the teeth 426 and lugs 434 engage one another.

Similar to the connection 338 provided by the container 300, when the lid 408 is in the engaged condition, the receptacle connector 420 and the lid connector 432 cooperatively provide a fractional-turn connection 438. The connection 438 is operable so that the connector teeth 426 and lugs 434 are rotatable into and out of engagement with one another. When the lid 408 is engaged, the connection 438 preferably restricts lid separation from the fill neck 418 (e.g., when the lid 408 is urged out of engagement with the fill neck 418 due to a pressure differential caused by pressure within the chamber 409).

The lid 408 is rotatable about a connection axis A2 (see FIGS. 47 and 48) between the engaged condition and a disengaged condition in which the connector teeth 426 and lugs 434 are disengaged from each other to permit removal of the lid 408 to uncover the fill opening 422. As the lid 308 rotates, the lid connector 432 is preferably rotatable relative to the receptacle connector 420 about the connection axis A2.

Figure 45:
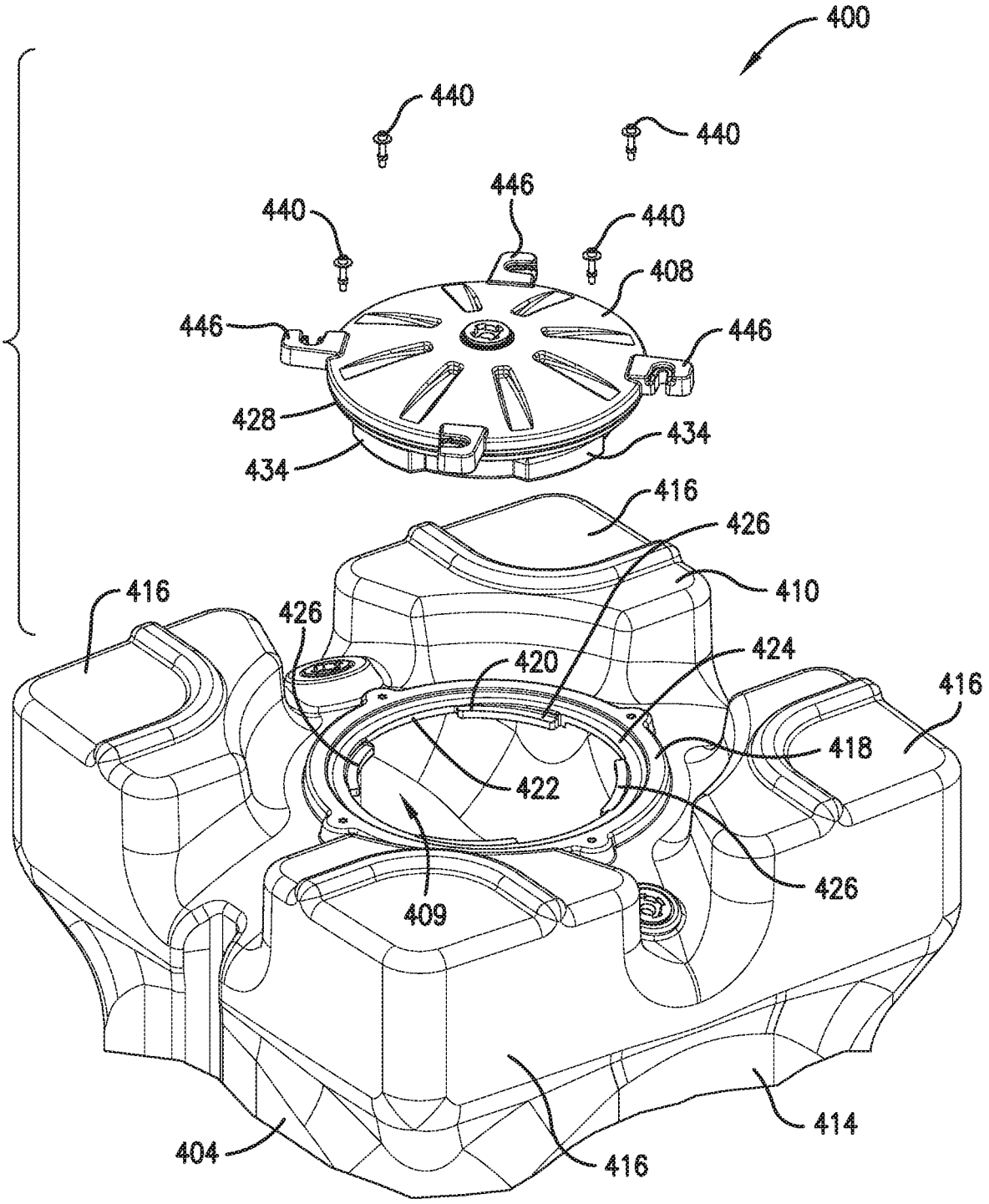
Figure 46:
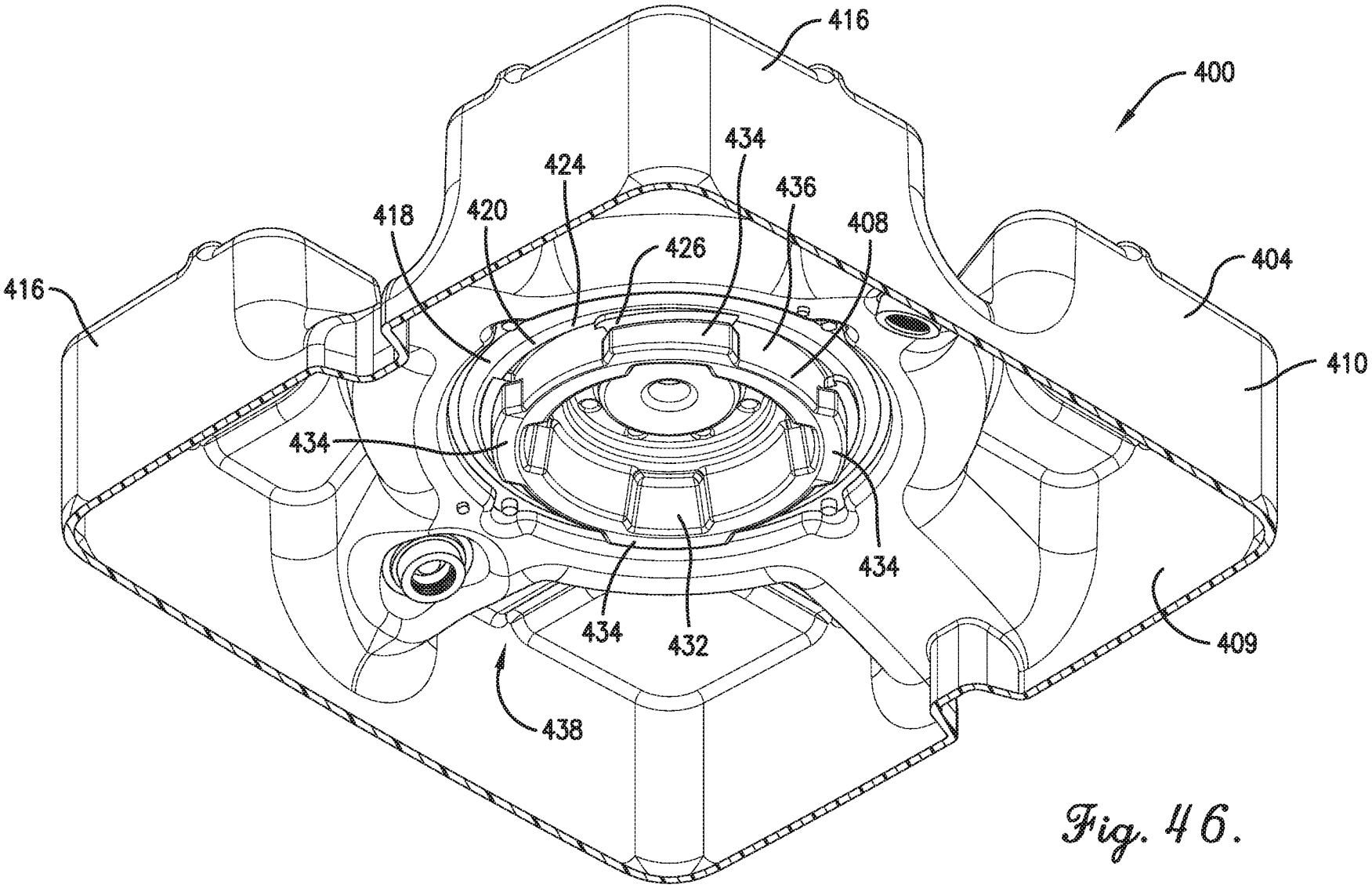
Figure 48:
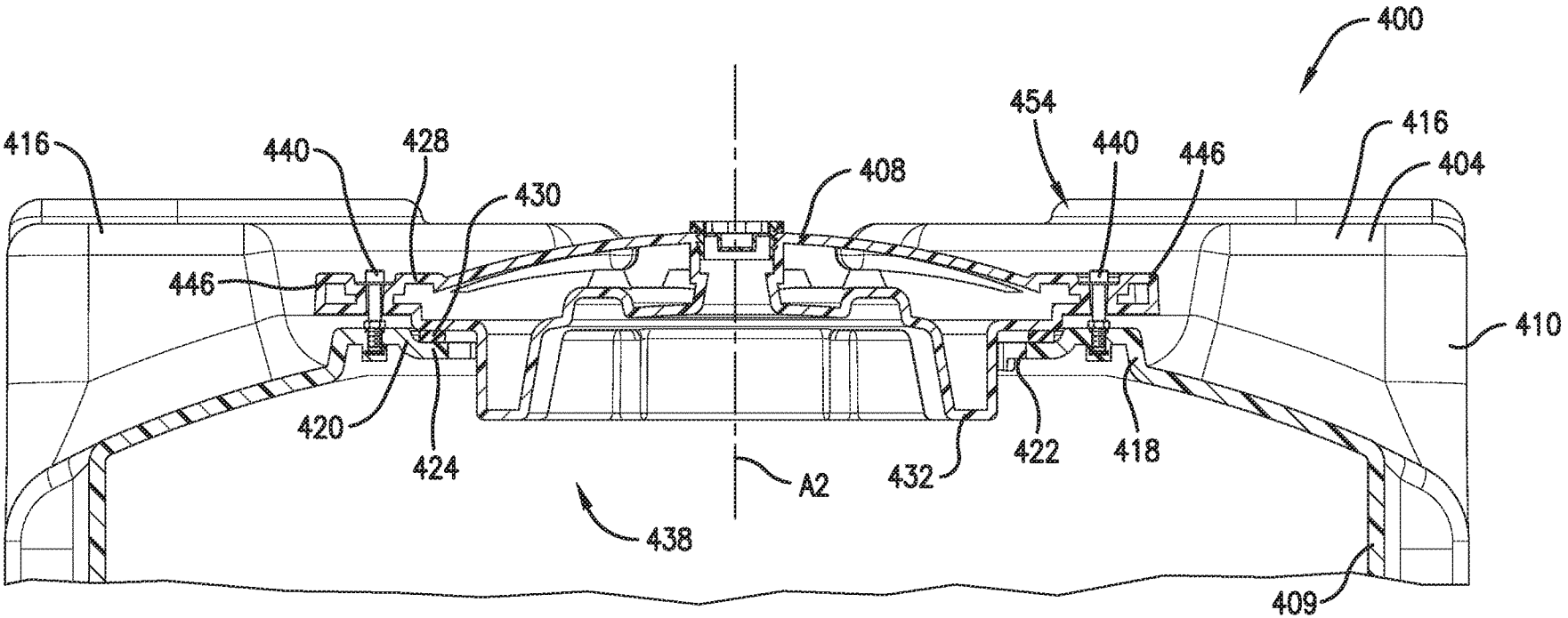
Figure 49:
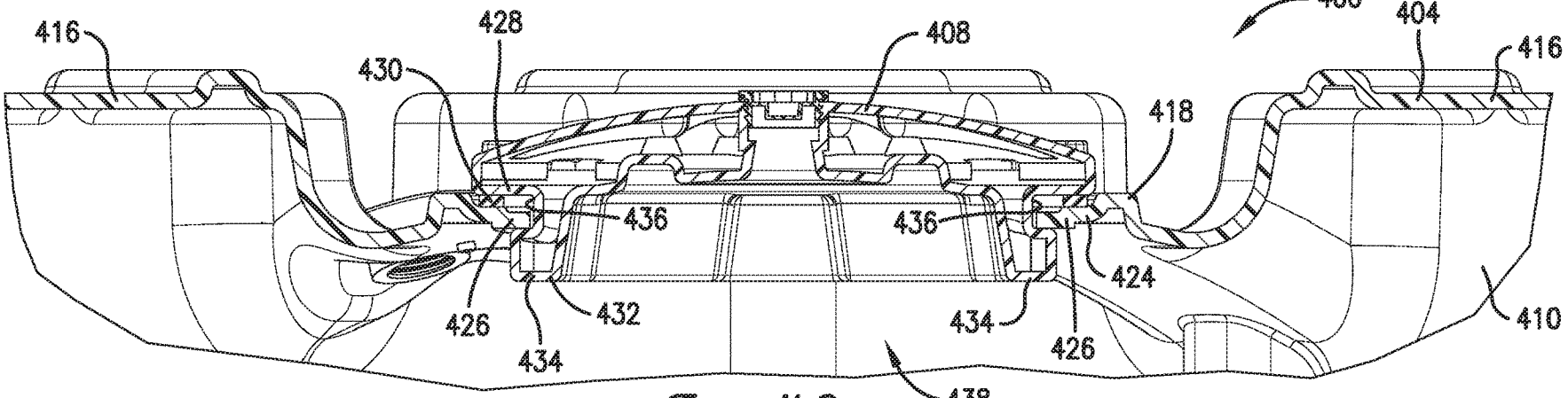
Figure 50:
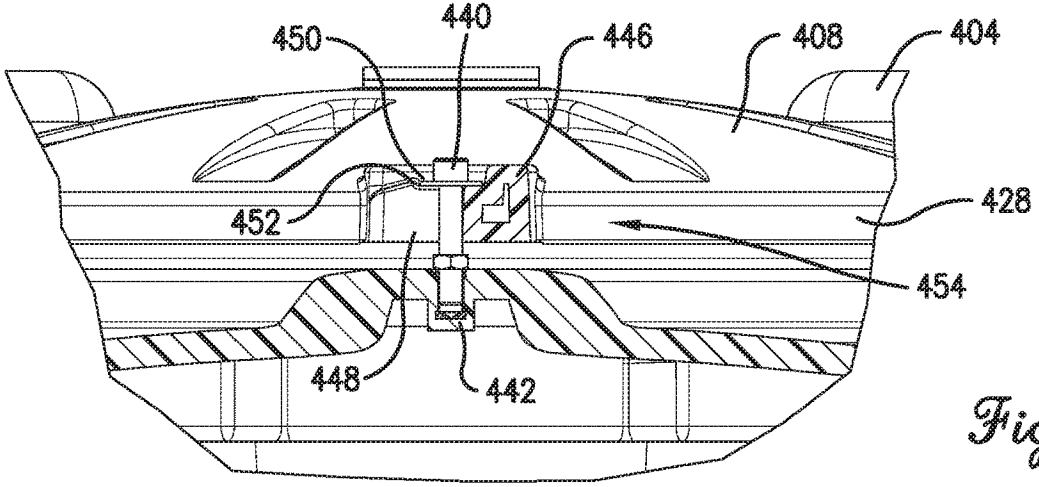

The container 400 also preferably includes a plurality of fasteners 440 for attachment to the receptacle 404 and the lid 408 in the engaged condition (see FIGS. 45, 48, and 50). The fill neck 418 of the receptacle 404 preferably includes a plurality of captive fasteners 442 (see FIG. 50) molded as part of the receptacle 404 and spaced about the fill opening 422 to receive the fasteners 440.

The lid flange 428 of the lid 408 also preferably comprises a connection flange with flange connectors 446 for removable attachment to the fasteners 440 (see FIG. 44). The flange connectors 446 each present a fastener slot 448 to slidably receive the corresponding fastener 440 (see FIGS. 47 and 50). The depicted fastener slots 448 extend along a circumferential direction relative to the fill opening 422 and cooperatively permitting rotation of the lid into and out of the engaged condition.

Figure 47:
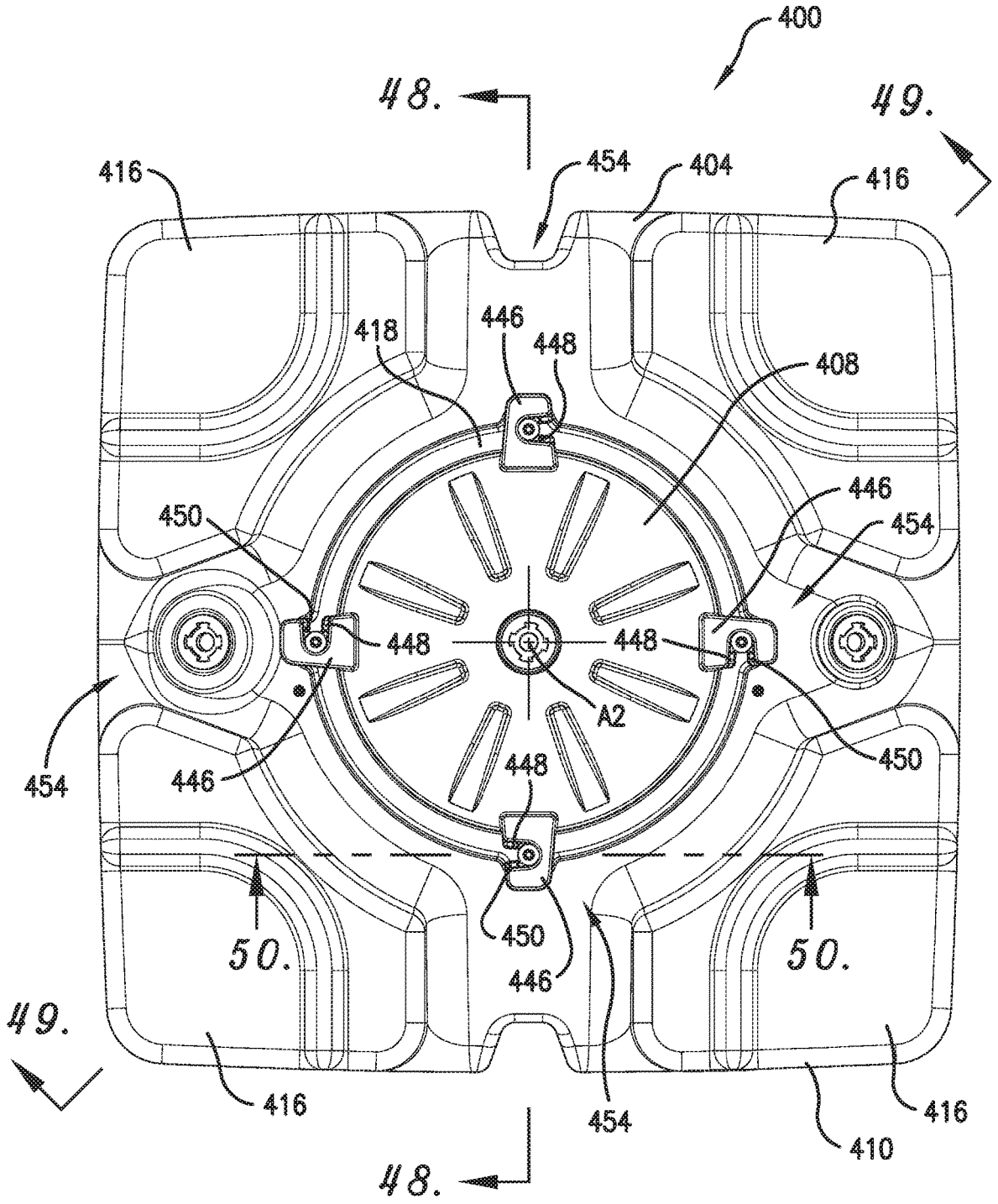

In the engaged condition, the fasteners 440 are preferably tightened into engagement with upper surfaces 450 presented by the flange connectors 446 (see FIGS. 47 and 50). Each flange connector 446 also preferably presents a detent 452 (see FIG. 50) that removably engages the respective fastener 440 in the engaged condition to provide a flange connection 454 that restricts rotation of the lid 408 out of the engaged condition.

It will be understood that each fastener 440 can be loosened out of engagement with the respective surface 450 and detent 452 while being attached to the captive fastener 442 and while the lid 408 remains in the engaged condition. With the fastener 440 loosened, the flange connection 454 permits rotation of the lid 408 between the engaged condition and the disengaged condition.

The flange connections 454 are preferably used in combination with the fractional-turn connection 438 to cooperatively hold the lid 408 in the engaged condition. However, it is within the scope of some aspects of the present invention for an alternative container to be provided with the flange connections but without the fractional-turn connection provided by the connector teeth and lugs.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

The invention claimed is:

1. A stackable container system configured to provide stacked receptacles for receiving bulk material therein, said stackable container system comprising:

a first receptacle configured to provide a respective stacked receptacle and including a receptable bottom, a receptable top, and a receptacle side extending along an upright container axis between the receptacle bottom and top, with the first receptacle presenting a container chamber, said receptacle top being configured to at least partly support another one of the stacked receptacles stacked relative thereto along the upright container axis, said receptacle top and said receptacle side having, respectively, a top peripheral margin and a side peripheral margin that extend laterally about the upright container axis, said receptacle top having corner sections that define at least part of the top peripheral margin so that the receptacle top has a generally polygonal profile shape, said side peripheral margin of the receptacle side having a generally rounded cross-sectional shape, with the corner sections being laterally outboard of the side peripheral margin to support the stacked receptacle when stacked relative to the first receptacle, said corner sections being interconnected to the side peripheral margin along a transition section that extends laterally to provide a continuous transition between the corner sections and the rounded receptacle side, said receptacle top including discrete pillars spaced apart from one another and a fill neck located between the pillars, said pillars being located at least partly above the fill neck, said pillars forming the corner sections of the receptacle top, with the corner sections being laterally outboard from the side peripheral margin and operable to support the stacked receptacle when stacked relative to the first receptacle, each of said pillars including a hollow structure that defines a respective part of the container chamber; and a shutoff wall fixed inside at least one of the pillars to define a subchamber and seal off the subchamber from the remainder of the container chamber.

2. The stackable container system as claimed in claim 1, said side peripheral margin of the receptacle side having a generally circular cross-sectional shape.

3. The stackable container system as claimed in claim 1, said receptacle side including a rib extending vertically between the receptacle bottom and top.

4. The stackable container system as claimed in claim 1, further comprising:

a pallet supported on the receptacle top and configured to support the another receptacle in a location stacked above the first receptacle.

5. The stackable container system as claimed in claim 4, said pallet having pallet corners engaged with respective corner sections of the receptacle top.

6. The stackable container system as claimed in claim 4, further comprising:

a second receptacle configured to provide a respective stacked receptacle and being supported on the pallet above the first receptacle.

7. A stackable container system configured to provide stacked receptacles for receiving bulk material therein, said stackable container system comprising:

a first receptacle configured to provide a respective stacked receptacle and including a receptable bottom, a receptable top, and a receptacle side extending along an upright container axis between the receptacle bottom and top, with the first receptacle presenting a container chamber, said receptacle top being configured to at least partly support another one of the stacked receptacles stacked relative thereto along the upright container axis, said receptacle top and said receptacle side having, respectively, a top peripheral margin and a side peripheral margin that extend laterally about the upright container axis, said receptacle top having corner sections that define at least part of the top peripheral margin so that the receptacle top has a generally square profile shape, said side peripheral margin of the receptacle side having a generally rounded cross-sectional shape, with the corner sections being laterally outboard of the side peripheral margin to support the stacked receptacle when stacked relative to the first receptacle, said corner sections being interconnected to the side peripheral margin along a transition section that extends laterally to provide a continuous transition between the corner sections and the rounded receptacle side, said receptacle top including discrete pillars spaced apart from one another and a fill neck located between the pillars, said pillars being located at least partly above the fill neck, said pillars forming the corner sections of the receptacle top, with the corner sections being laterally outboard from the side peripheral margin and operable to support the stacked receptacle when stacked relative to the first receptacle, each of said pillars including a hollow structure that defines a respective part of the container chamber; and a shutoff wall fixed inside at least one of the pillars to define a subchamber and seal off the subchamber from the remainder of the container chamber.

* * * * *